US009217258B2

(12) United States Patent
Salapatek et al.

(10) Patent No.: US 9,217,258 B2
(45) Date of Patent: Dec. 22, 2015

(54) METHOD AND CHAMBER FOR EXPOSURE TO NON-ALLERGIC RHINITIS TRIGGER ENVIRONMENTS

(75) Inventors: Anne Marie Salapatek, Mississauga (CA); Piyush Ranchodbhai Patel, Mississauga (CA)

(73) Assignee: INFLAMAX RESEARCH, INC., Mississauga (CA)

( * ) Notice: Subject to any disclaimer, the term of this patent is extended or adjusted under 35 U.S.C. 154(b) by 639 days.

(21) Appl. No.: 13/254,755

(22) PCT Filed: Mar. 8, 2010 (Under 37 CFR 1.47)

(86) PCT No.: PCT/CA2010/000325
§ 371 (c)(1), (2), (4) Date: Jun. 20, 2012

(87) PCT Pub. No.: WO2010/099625
PCT Pub. Date: Sep. 10, 2010

(65) Prior Publication Data

US 2012/0316402 A1 Dec. 13, 2012

Related U.S. Application Data

(60) Provisional application No. 61/158,149, filed on Mar. 6, 2009.

(51) Int. Cl.
*E04H 3/08* (2006.01)

(52) U.S. Cl.
CPC ..... *E04H 3/08* (2013.01)

(58) Field of Classification Search
CPC .. A61H 2201/105; A61K 9/0075; B01L 1/00; B05C 15/00; B60H 3/00; B60H 3/0071; G01N 33/48771; G03G 21/206; G05B 13/042; G05B 2219/2642; Y02B 30/78
See application file for complete search history.

(56) References Cited

U.S. PATENT DOCUMENTS

| | | | | |
|---|---|---|---|---|
| 5,935,516 | A | 8/1999 | Baugh | |
| 2004/0054262 | A1* | 3/2004 | Horak | 600/300 |
| 2007/0286804 | A1 | 12/2007 | Patel et al. | |
| 2008/0210234 | A1 | 9/2008 | O'Brien et al. | |

FOREIGN PATENT DOCUMENTS

JP 10-314241 A 12/1998

OTHER PUBLICATIONS

Balansky et al. Carcinogensis vol. 21 No. 9 pp. 1677-1682, 2000.*
(Continued)

*Primary Examiner* — Sally Merkling
(74) *Attorney, Agent, or Firm* — Bereskin & Parr LLP

(57) ABSTRACT

The present invention is a method and chamber for exposure of human subjects to non-allergic rhinitis ("NAR") trigger environments. The method occurs in a NAR chamber and involves tests that expose subjects to environmental triggers known to induce NAR symptoms. The chamber may be an enclosure capable of housing multiple subjects, constructed to facilitate the NAR tests and/or challenges and operable to create one or more NAR environments within the chamber. A different NAR environment may be required for each test. The chamber may facilitate the creation and containment of a specific NAR environment relating to a NAR test and/or challenge within the chamber for a particular period of time and achieve air-flow therein whereby subjects positioned within the chamber may be exposed to a NAR trigger environment in a virtually consistent manner. NAR tests and challenges may be assessed and the results thereof may be stored, compiled and/or reported.

21 Claims, 15 Drawing Sheets

(56) References Cited

OTHER PUBLICATIONS

Braat et al. (AmJ Respir Crit Care Med vol. 157. pp. 1748-1755, 1998.*

Ernstgard et al. (Toxicology Letters 165 (2006) 22-30).*

Liu et al. (Environ. Sci. Techno. 2004, 38, 2802-2812).*

International Search Report for International Application No. PCT/CA2010/000325, mailed Jul. 23, 2010.

* cited by examiner

METHOD AND CHAMBER FOR EXPOSURE TO NON-ALLERGIC RHINITIS TRIGGER ENVIRONMENTS

FIELD OF INVENTION

This invention relates in general to the field of investigation of non-allergic rhinitis in humans and more specifically to methods and chambers for undertaking such investigation.

BACKGROUND OF THE INVENTION

The term non-allergic rhinitis ("NAR") is generally applied to a diagnosis where symptoms of allergic rhinitis are present without allergic etiology or IgE involvement. NAR encompasses a heterogeneous group of conditions with varying etiologies, including vasomotor rhinitis, non-allergic non-infectious perennial rhinitis, occupational rhinitis, drug-induced rhinitis, hormonal-induced rhinitis, non-allergic rhinitis with eosinophilia syndrome, gustatory rhinitis and emotion-induced rhinitis (See: Bachert C (2004) Persistent rhinitis—allergic or non-allergic? *Allergy* 59 (Suppl. 76): 11-15). A diagnosis of NAR is often made when subjects with negative skin prick testing for a panel of allergens present with persistent nasal symptoms (more than nine months a year) including at least two of the following: hypersecretion, blockage, sneezing or post-nasal drip. Subjects typically have one symptom that predominates and can be classified into: runners for those in which hypersecretion predominates; or blockers for those in which congestion predominates.

Within a rhinitis population, it has been estimated that approximately twenty-three percent (23%) of the population have pure NAR (characterized by nasal symptoms but a negative skin prick test) and thirty-four percent (34%) of the population have mixed rhinitis (a combination of allergic and non-allergic). While not a life threatening illness, the impact of NAR on quality of life is significant and includes impaired sleep, increased daytime drowsiness, decreased ability to concentrate, and increased irritability (See: Svensson S, Olin A C and Hellgren J (2006) Increased net water loss by oral compared to nasal expiration in healthy subjects. *Rhinology.* 44: 74-77).

Numerous triggers of NAR have been identified. Such identification has primarily involved subject reporting. NAR triggers can be classified into various groups such as weather changes, airborne irritants, emotions and food or alcohol. Weather changes include changes in temperature, humidity or barometric pressure; in particular, cold dry air and warm moist air have been identified as strong triggers (See: Brandt D and Bernstein J A (2006) Questionnaire evaluation and risk factor identification for nonallergic vasomotor rhinitis. *Annals Allergy Asthma & Immunol.* 96: 526-532). Numerous airborne irritants have been identified as common triggers of NAR including perfumes and colognes, household cleaning products, incense, hairspray, tobacco smoke, car exhaust, acetic acid and capsaicin spray. Spicy foods and alcohol intake have also been identified as risk factors for NAR.

Clinical models to increase an understanding of NAR, or to test putative NAR therapies are currently not available. Consistently NAR subjects report that their symptoms are primarily provoked by key environmental triggers such as cold dry air (CDA), fragrance, pollution (e.g. ozone may be an important element of pollution), and aerosolized irritants. Presently there is no consensus on specific environmental triggers that evoke nasal symptoms in pure NAR subjects. Previous attempts to diagnose NAR triggers predominantly involved questionnaire approaches.

Utilizing a chamber having an inlet for allergen test particles is known in the prior art to test subjects for allergic reactions to a specific allergen, for example as disclosed in US Patent Application No. 2004/0054262. This patent application discloses an allergy test chamber. The chamber comprises at least one inlet for allergen test particles, so that a defined quantity of allergens may be mixed with allergen-free air and allergen particulate-loaded air may be circulated in the test chamber.

US Patent Application No. 2007/0286804 further discloses a chamber in which airborne particulates relating to testing for a particular allergen are aerosolized and kept within strict limits. Said chamber is a level II clean room, having seating capacity for 60 subjects. The chamber comprises a means of controlling humidity and temperature which includes clean air vents as well as air inlets and outlets fitted with HEPA filters. Other aspects of the chamber are specifically configured for the purpose of testing allergic reaction of a subject to dust-mite allergens including walls covered with statically dissipative paint, rounded corners and baseboards, and a floor covered with smooth, resilient, sheet flooring with few seams.

Other containment chambers operable to create a specific atmosphere within the chamber are also known generally in the prior art. These containment chambers are not utilized for the purpose of allergy or NAR testing. Such chambers include that disclosed in U.S. Pat. No. 7,323,025 (and U.S. patent application Ser. No. 2005/0050804) which comprises a sleeve air exchange, an airlock entrance, a HEPA filter, a pressure control means, and a UV radiating unit; wherein a subject requiring isolation may be positioned to achieve containment of an infectious disease. U.S. Pat. No. 7,335,243 further discloses a modular negative pressure biological containment chambers having HEPA or ULPA filters, double entry portals and modular chamber panels; whereby biological materials may be contained. U.S. patent application Ser. No. 2008/0210234 discloses a variable pressure chamber having an air-tight container, a sealable opening, a viewing window, chairs for subjects, space for multiple subjects inside the container, dual lock entry, an air flow means, a pressure monitoring and control means; whereby a subject may be positioned within the container and the pressure may be adjusted within the container in accordance with a desired subject within the container for the purpose of treatment of the subject.

SUMMARY OF THE INVENTION

In one aspect, the present disclosure relates to a method of exposing subjects to one or more NAR trigger environments characterized in that it comprises the steps of: selecting one or more NAR challenges; undertaking for each of the one or more NAR challenges the further steps of: creating the one of the one or more NAR trigger environments corresponding to the NAR challenge within a chamber by disseminating a NAR trigger within the chamber; exposing one or more subjects to the NAR trigger environment by positioned the one or more subjects within the chamber for a period of time; and assessing the exposure of the one or more subjects to the NAR trigger environment to produce NAR challenge data; and evaluating the NAR challenge data of the one or more NAR challenges.

In another aspect, the present disclosure relates to a chamber for creating one or more NAR environments to conduct one or more NAR challenges, characterized in that it comprises: an air handling system operable to create the one or more NAR environments by disseminating a selected NAR trigger within the chamber by way of one or more NAR environment generation means; one or more level indicators being operable to indicate levels within the chamber of the NAR environment; one or more fans operable to facilitate a flow of fresh air within the chamber; and one or more positions for one or more subjects within the chamber.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein:

FIG. 4(*b*) is a graphical representation of the results of a cold dry air challenge period of 60 minutes in accordance with Study 1 showing the increase in mean percent change from baseline of the nasal symptoms of participants that are NAR responders.

FIG. 4(*c*) is a graphical representation of the results of a cold dry air challenge period of 60 minutes in accordance with Study 1 showing the nasal patency of nasal congestion of participants.

FIG. 5(*b*) is a graphical representation of the results of a temperature change challenge period of 120 minutes in accordance with Study 1 showing the increase in mean percent change from baseline of the nasal symptoms of participants that are NAR responders.

FIG. 5(*c*) is a graphical representation of the nasal patency over a temperature change challenge period of 120 minutes in accordance with Study 1 showing the nasal patency of nasal congestion of participants that are NAR responders.

FIG. 7(*b*) is a graphical representation of the results of a fragrance challenge period of 30 minutes in accordance with Study 1 showing the nasal patency of nasal congestion of participants that are NAR responders.

FIG. 8(*b*) is a graphical representation of the results of an irritant challenge period of 15 minutes in accordance with Study 1 showing the nasal patency of nasal congestion of participants that are NAR responders.

FIG. 9(*b*) is a graphical representation of the results of an ozone challenge period of 120 minutes in accordance with Study 1 showing the nasal patency of nasal congestion of participants that are NAR responders.

FIG. 11(*b*) is a graphical representation of the mean change from baseline of the total nasal symptom score over a cold dry air challenge period of 60 minutes showing data from healthy normal volunteers in accordance with Study 2.

FIG. 12(*b*) is a graphical representation of the mean change from baseline of the total ocular symptom score over a cold dry air challenge period of 60 minutes showing data from healthy normal volunteers in accordance with Study 2.

FIG. 13(*b*) is a graphical representation of the mean change from baseline of the total nasal symptom score over an ozone challenge period of 90 minutes showing data from healthy normal volunteers in accordance with Study 2.

FIG. 14(*b*) is a graphical representation of the mean change from baseline of the total ocular symptom score over an ozone challenge period of 90 minutes showing data from healthy normal volunteers in accordance with Study 2.

Figure 1:
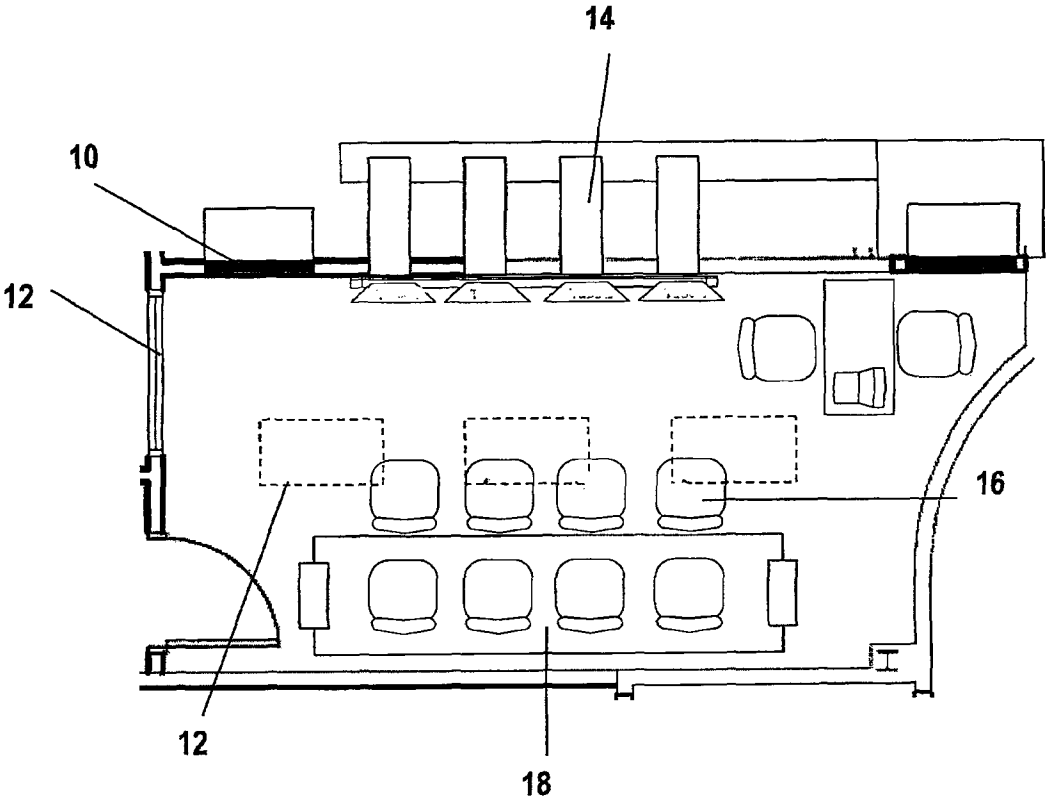
FIG. 1 is a top view of a subject exposure area of a chamber.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

The present invention is a method and chamber for exposure of human subjects to NAR trigger environments. The method includes a series of NAR tests which involve the exposure of subjects within a chamber to environmental triggers known to induce NAR symptoms in a controlled and assessable manner. The chamber may be an enclosure capable of housing multiple subjects and which is constructed to facilitate the tests and is consequently operable to create a specific environment within the chamber as required for each test. The chamber facilitates the containment of the specific environment within the chamber and achieves air-flow therein whereby subjects experience the environment in a virtually consistent manner. Such air flow may differ for each NAR test. The method and chamber thereby create effective NAR tests capable of rendering reliable results which may be assessed and reported.

The chamber may be controlled to create a variety of environments, each being capable of disbursing, disseminating, introducing or otherwise allowing a particular NAR trigger to exist within the environment inside the chamber. In some embodiments of the present invention the environment within the chamber may involve an allergen particulate, such as ozone or fragrance. In other embodiments of the present invention the environment within the chamber may not involve an allergen particulate, but may involve a particulate-free atmosphere, for example such as cold dry air, or hot humid air. The environment within the chamber may disburse, disseminate, introduce or otherwise allow a particular NAR trigger to exist for a specific period of time.

Subjects may be exposed to a NAR trigger within the chamber during a specific period of time. The subjects, or participants may be exposed to the NAR trigger while located at a specific position within the chamber, in accordance with a particular NAR test. For example, the position of the subjects, or participants may be different if the NAR trigger within the chamber is ozone than if the NAR trigger within the chamber is cold dry air. The position of the subjects may be determined in accordance with the required exposure of the subjects or participants to the NAR trigger within the chamber.

The exposure of the subject to a NAR trigger may be monitored from outside the chamber by one or more persons and instruction may be directed to the subjects within the chamber. Once a particular NAR test is completed the chamber may be operated to create a different environment to disburse, disseminate, introduce or otherwise allow a different NAR trigger within the chamber. In this manner the chamber may be utilized for multiple NAR tests and may be utilized to operate the entirety of a series of NAR tests. Each test may involve a different environment, having a different NAR trigger, within the chamber and may further require variant positioning of subjects within the chamber for the tests.

In one embodiment of the present invention, the NAR tests and/or challenges may involve one or more subjects at a time. The number of subjects will depend upon several elements of the present invention, including the size of the chamber as well as the NAR trigger being tested that is disbursed, disseminated, introduced or otherwise allowed within the chamber environment. A NAR series of tests may apply five natural triggers of NAR, such as, for example static or dynamic regimes, irritant, fragrance, and ozone. An environment for exposure to each NAR trigger may be created within the chamber.

The target levels of triggers and the lengths of the each NAR test challenges may be determined based on safety guidelines and standards, as well as other factors, such as prior tests or research. A primary efficacy variable may be the mean change from baseline in total nasal symptom score. Secondary efficacy variables may include: the mean change from baseline in individual symptom severity; the mean change from baseline in nasal patency measured using acoustic rhinometry; and the nasal secretion weight. A skilled reader will recognize that other efficacy variables and parameters may be analyzed, such as, for example on an exploratory basis, using the method and chamber of the present invention.

The chamber of the present invention may be a controlled facility operable to affect factors of humidity, temperature, airborne irritants and air flow and thereby create a particular environment within the chamber. In particular the chamber may create environments that may be utilized for the purpose of testing NAR trigger exposure.

The present invention may allow for the examination of the efficacy of putative therapeutics or devices for the condition of NAR in multiple subjects simultaneously within a single chamber in a controlled setting. The chamber may be designed to accommodate multiple subjects as well as provide space for equipment and investigators. The chamber may incorporate a custom air flow generator which can direct temperature-controlled and humidity-controlled air at subjects at defined velocities, allowing for the study of NAR triggers induced by environmental changes. Sensor feedback and control may be fully automated with real-time computerized monitoring and output capabilities.

In an embodiment of the present invention the chamber may include areas where the NAR trigger is not disbursed, such as, for example an observation area to facilitate subject monitoring, an equipment area, or other area for use in an aspect of the NAR testing.

The present invention offers several benefits over the prior art. Most notably, the chamber and method are not limited to the production of allergen particulate-laden air for a single test for a particular allergy. Thus the present invention is not simply an application of allergen aerosolization, but rather is dedicated to alteration of environmental conditions (for example, involving multiple NAR triggers) for the study of NAR and related syndromes. Moreover, the chamber and method may involve a series of NAR tests.

Further benefits of the present invention over the prior art are referenced below. These include benefits of the series of NAR tests of the method of the present invention over prior NAR tests.

The method of the exposure of subjects to NAR triggers of the present invention may involve a variety of NAR trigger inducing environments. Each environment may be created for a specific test, and facilitated in accordance with set parameters by the chamber. For example, temperature, humidity, ozone, fragrance and irritants, such as, for example household irritants, are reported NAR triggers. The chamber may be utilized to create an environment to disburse, disseminate, introduce and otherwise allow each of these triggers one at a time. Sensors may be applied to indicate when an environment capable of evoking a NAR trigger response is achieved within the chamber. When an environment capable of evoking a NAR trigger response is achieved one or more subjects may enter the chamber and take up a position therein. Specific factors may be applied to the procedure for each NAR test conducted in the chamber. Factors may differ for each NAR test, and some factors may be common to all NAR tests. For example, the time a subject spends in the chamber may vary for each test. Additionally, each subject may be directed to a position for each test that causes the subject to achieve a particular exposure to the NAR trigger inducing environment. A skilled reader will recognize that other factors and parameters may vary for NAR tests.

In an embodiment of the present invention, while in the chamber subjects may receive training or instruction to facilitate aspects of the test. A viewing means may be incorporated into the chamber whereby one or more test appliers may be able to observe the inside of the chamber while positioned outside the portion of the chamber having an environment wherein the NAR trigger is disbursed, disseminated, introduced or otherwise allowed. The viewing means may facilitate monitoring of subjects during exposure to a NAR environment.

Once a NAR test is completed the chamber may be operated to create a different environment and thereby be prepared to disburse, disseminate, introduce or otherwise allow a different NAR trigger for a different NAR test. For example, the NAR test method may require an NAR test for the NAR trigger of ozone first and another NAR test for the NAR trigger of irritant to follow the ozone test. In such an embodiment of the present invention the chamber may be operated to dissipate the prior environment, being the ozone environment, and to introduce a subsequent environment, being the irritant environment. A skilled reader will recognize that a variety of NAR tests may be applied and therefore this step may be repeated several times and may involve altering the environment within the chamber from one NAR test environment to another NAR test environment. Each NAR test environment may facilitate exposure of a subject to a specific NAR trigger. The grouping of one or more NAR tests may represent a series of NAR tests. One or more subjects may undergo a series of NAR tests, or alternatively one or more subjects may undergo a single NAR test.

Data may be collected regarding the reaction of the subjects to each NAR test environment. Such data may be compiled for each individual NAR test, for a series of NAR tests, or for a collection of two or more NAR tests, as well as for individual subjects or for groups of subjects (e.g. subjects identified as affected with Non-Allergic Rhinitis). The results of such compiled data may provide information regarding NAR triggers and/or a subject's exposure to a NAR trigger. A skilled reader will recognize that such data will have a variety of applications, such as subject diagnosis, NAR syndrome study, establishing NAR trigger tolerance levels, as well as other applications.

Embodiments of the present invention may include a chamber incorporating several elements. Such elements may represent a means of creating a specific environment to disburse, disseminate, introduce or otherwise allow a NAR trigger within the chamber, such as, for example, fragrance introduced into the chamber environment by way of a fragrance dispenser, ozone introduced into the chamber environment by way of an ozone generator, irritants such as acetic acid introduced into the chamber environment by way of an atomizer or vaporizer, or temperatures and/or humidity created within the chamber by an air handling system. A skilled reader will recognize that a variety of elements may be incorporated in the chamber.

In one embodiment of the present invention an air handling system may control all air input and output in the chamber and the conditions of the air to create the desired environment from user-specified temperature, humidity and air velocity levels. The chamber may be capable of creating environments having specific target parameters, such as, for example within the range of approximately 10-40° C., 5-60% relative humidity and 0-10 ft/sec air velocity. The air handling system may be composed of a number of individual components and sensors to control the air handling system. These components and sensors may be installed at the manufacturer prior to on-site installation of the air handling system.

In another embodiment of the present invention the air handling system may be comprised of two separate yet integrated systems, namely a base system and a velocity tube system (as described below). The base system may control the temperature, humidity and volume of the air entering the chamber via one or more supply vents. As shown in FIG. 1, supply vents 12 may be ceiling mounted. This air may be returned to the air handling system via at least one return vent. The return vent 10 may be mounted close to the floor and may be positioned on the wall opposite the subject seating area. A skilled reader will recognize that other positions are possible for the supply and return vents.

An air handling system may further be utilized to control air velocity levels in each NAR test environment. The air velocity levels in a NAR test environment may facilitate the interaction of NAR triggers with the subjects. For this, as well as the other purposes, the air handling system may incorporate a base system that includes supply and return air vents, a dehumidifier, such as, for example a silica gel-based desiccant wheel dehumidifier, a humidifier and a condensing unit.

In an embodiment of the present invention that incorporates a silica gel desiccant wheel dehumidifier, said dehumidifier may remove moisture from the air in an absorption process. The wheel may be used to remove moisture from the chamber return air and re-circulate dry air back into the chamber through air ducts and discharges. Said air ducts and discharges may be custom designed. The moisture trapped within the desiccant wheel may be heat-reactivated and released to the outside via an exhaust. The moisture-depleted dry air may be re-introduced into the chamber through the air handling system and an air flow generator. The humidifier may be utilized to introduce humidity and moisture into the conditioned air prior to the entry of the air into the chamber. The level of humidity within the chamber may be controlled by set-points, which may be defined by a user. The chamber may be capable of achieving levels within the range of 5-60% relative humidity. The air cooled condensing unit may be primarily responsible for providing cooling to the air handling system, which may in turn allow the introduction of cooled air into the chamber. The exhaust fan functions may remove $CO_2$-satured air from the chamber, thus maintaining $CO_2$-levels at acceptable limits for human occupation. The exhaust fan may also serve to create and/or maintain the pressure levels within the chamber.

The air handling system may further include a velocity tube system whereby temperature conditioned air may be delivered into the chamber in a velocity-controlled manner. The velocity tube system may include an air flow generator having a cooling component that supplies all velocity tubes simultaneously. The velocity tubes of the velocity tube system may be positioned behind the wall of the chamber. Each tube may feed an air discharge that may be mounted opposite the subject seating area and may be manually rotatable. Each velocity tube may have an independently controlled heater and air velocity damper.

In one embodiment of the present invention, as shown in FIG. 1, the velocity tube system 14 may be comprised of an air flow generator and one or more velocity tubes. The air flow generator may be custom-designed to deliver temperature conditioned air directly to subjects in a velocity-controlled manner. In one embodiment of the present invention, four circular, 8-inch diameter, air discharges may be located on the wall opposite the subject seating and each may be fed by a separate air velocity tube mounted behind the chamber wall. Each air velocity tube may contain a specialized damper allowing precise, automated manipulation of the air velocity from 0-10 feet/second. Each air velocity tube may also contain a heater that can be independently controlled to allow precise manipulation of heating through the velocity discharges. The air flow generator supplying the velocity tubes may contain a single cooling component that supplies all four velocity tubes simultaneously. The combination of the independent heating coils and the common cooling coil may allow the precise control of the temperature of the air leaving the discharges and being directed at subjects. The air flow generator and air velocity tubes may not have dehumidification or humidification capabilities independent from the base system and consequently may rely on the base system to humidify the air appropriately. The air may then be re-circulated through both air handling systems and delivered to subjects via the air discharges. The air discharges may be manually rotatable allowing directional control of air flow towards subjects' faces and facilitating the capability for each discharge to direct air at two subjects simultaneously. A skilled reader will recognize that other velocity tube system configurations may be incorporated in the present invention.

In one embodiment of the present invention the air handling system may be automated. For example, automation may be controlled by a known system, such as, for example Carrier Comfort Controller 6400™ and Carrier Comfort-VIEW™ software. In such an embodiment the software may control all components of the air handling system in response to user-defined set-points as indicated in the Comfort-VIEW™ interface screens. Temperature, relative humidity and air velocity may be the commonly controlled parameters used to create specific environments within the chamber. A skilled reader will recognize that other automation means may be applied to the air handling system.

In another embodiment of the present invention, the air handling system may include one or more sensors or detectors being operable to indicate aspects of the environment within the chamber. Such sensors or detectors may measure aspects of the NAR environment, including temperature, humidity, carbon dioxide and barometric pressure. A skilled reader will recognize that a variety of sensors and/or detectors may be utilized in the NAR chamber to measure a variety of aspects of the NAR environment, such as, for example a photoionization detector, an ozone monitor or an irritant vapor monitor which may incorporate colorimetric tubes. The air handling system may further include at least one fan. An exhaust fan should be included in the air handling system.

In one embodiment of the present invention, three detectors may be utilized, such as, for example temperature, relative humidity and carbon dioxide. The detectors may be duct-mounted within the return air vent in the chamber to monitor the environmental conditions of the chamber. A single barometric pressure sensor may be located on the ceiling of the chamber. In one embodiment of the present invention, all temperature and humidification control may be through the automation system, such as, for example an automation system that is software driven, such as, for example Comfort-VIEW™ software. The automation system may incorporate specific set-points that are defined and utilized to regulate the environment of the chamber. In another embodiment, $CO_2$ may be only monitored. Such a system may have the capacity to utilize this detector to control fresh air input if desired in the future. In another embodiment of the present invention, barometric pressure may be monitored and/or controlled.

In yet another embodiment of the present invention, to further facilitate a NAR environment within the chamber, the walls of the chamber may be coated. For example the walls of the chamber may be painted with epoxy paint and imbedded with a copper mesh to create an electrostatically dissipative surface to reduce static electricity generated as a result of the extreme low humidity levels. Within the chamber there may be a designated area for assessment equipment as well as seating for an investigator and subject. The seating for the investigator may be in an area that is divided from the environment where the NAR trigger is disseminated.

Figure 3:
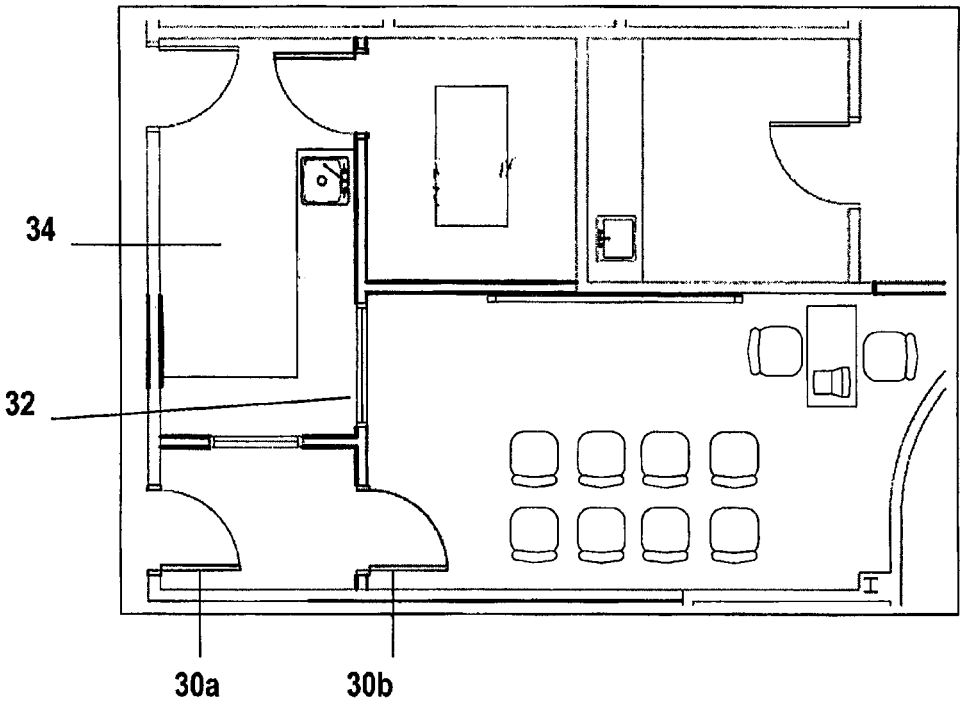
FIG. 3 is a top view of a chamber.

The chamber may incorporate an airlock entrance to diminish the potential for contamination of the chamber NAR environment by the atmosphere exterior of the chamber, or in areas where the NAR trigger is not disseminated, when the chamber environment where the NAR trigger is disseminated is entered or exited. A skilled reader will recognize that a variety of entrance configurations may be utilized to protect the chamber environment where the NAR trigger is disseminated. For example, the airlock may be under negative pressurization which can assist in maintaining the environment created within the chamber. One possible configuration is shown in FIG. 3, in that the airlock may have two doors, a door 30*b* to the chamber and a door 30*a* from the exterior hallway. Each door may only be opened independently. The entrance to the chamber may include a passageway.

Inside the chamber height variations may be incorporated, such as, for example by the inclusion of risers. Seating for the subjects may also be included within the chamber. The heights and seating may be specifically positioned so as to cause subjects to be exposed to the NAR test environments in a way that produces particular trigger effects. The riser may be constructed of a metal framework, with one step on either end to the top of the riser and may be equipped with an anti-slip surface. The chairs may also have tablet arms to facilitate subjective symptom scoring during the NAR tests.

As shown in FIG. 1, in one embodiment of the present invention seating 16 for eight subjects may be positioned in two rows of four, with the second row on a tiered riser 18 behind the first. Both the riser and the chairs may be designed and selected based on maximizing air flow within the room and reducing turbulence. Four circular, each eight-inches in diameter, air discharges may be located on the wall opposite the subject seating. Each air discharge may be fed by a separate duct containing specialized controls allowing precise, automated manipulation of the air velocity. Each air discharge may direct air at two subjects, one in the front row and one directly behind on the riser. The discharges may be manually rotatable allowing directional control of air flow towards the subjects' faces. A skilled reader will recognize that other configurations of seating, risers and air discharge may be incorporated in the present invention.

Instruction of the subjects may be facilitated by an instruction means, or other communication means, accessible within the chamber. For example the instructions means may include a television, an audio system, a computer, or any other means of communicating with the subjects so as to provide instructions. The instruction means may facilitate interaction between a subject and other persons located outside the chamber, or may solely permit instructions to be presented to a subject. The interaction means may additionally be utilized to provide entertainment for the subjects while they are within the chamber.

The chamber may include one or more windows whereby the interior of the chamber may be viewed from outside the chamber, or from an area in the chamber that is separated from the area where the NAR trigger is disseminated. Such windows may be located in the airlock, in one or more walls of the chamber, and/or in any other position to facilitate a view within the chamber from the exterior of the chamber, or a view of within the environment of the chamber where a NAR trigger is disseminated from a separated area where the NAR trigger is not disseminated. As shown in FIG. 3, the one or more windows 32 may be connected to an area exterior to the chamber, for example, such as an observation room 34. The windows may allow real-time subject monitoring by a person, such as, for example one or more investigators conducting the NAR test. An ability to monitor the chamber area where the NAR trigger is disseminated may allow an investigator to affect subject compliance with the NAR test and any related clinical protocol. Monitoring may be real-time subject monitoring.

It may be possible for a person exterior to the chamber to communicate with the subjects. Such communication may be based upon the monitoring of the subjects, or any other type of communication. For example, the chamber and an area at the exterior of the chamber, such as an observation room, may be equipped with an intercom system. The intercom system may facilitate investigator-subject interactions, which may include an investigator providing directions to the subject. The communication means and instruction means may be facilitated by a single device. A skilled reader will recognize that the one or more windows, subject monitoring and communication aspects of the present invention may be achieved through other means.

In one embodiment of the present invention, the chamber may be designed to clean room level II standards.

In another embodiment of the present invention, the chamber may be a variety of proportions, such as, for example 10.5×19 feet. A skilled reader will recognize that the proportions of the chamber may be configured to promote effective NAR testing within the chamber.

In yet another embodiment of the present invention the method of a series of NAR tests may be conducted utilizing the chamber. For example, a series of NAR tests may be comprised of five (5) distinct challenges: cold dry air, temperature change, ozone, fragrance and irritant. A skilled reader will recognize that other series of NAR tests may be utilized in the method of the present invention utilizing the chamber, but the series of five challenges is presented as an example of the present invention. For the purpose of this document NAR tests may also be referenced as challenges. The target levels of each of the challenges in the example series of NAR tests may be as follows:

| | |
|---|---|
| Cold Dry Air | Temperature of 14 ± 5° C., relative humidity (RH) of <15%, air velocity of 5 ft/sec |
| Temperature Change | Temperature of 35 ± 5° C. for 1 hr and then 14 ± 5° C. for 1 hr, both at 10-40% relative humidity and air velocity of 5 ft/sec |
| Ozone | 0.2 ± 0.1 parts per million (ppm) |
| Fragrance | 6 ± 3 ppm |
| Irritant | 15 ± 5 ppm |

The chamber and method of the present invention may be altered for each NAR test challenge. The following provides examples of the possible NAR environments that may be created within the chamber for each NAR test/challenge. A skilled reader will recognize that the possible NAR environments within the chamber are presented merely as examples and that the present invention may involve other NAR tests/challenges and environments. A skilled reader will further recognize that aspects of each NAR test/challenge, for example such as calibration process, objectives, targets, etc., may be applied to NAR tests/challenges other than the NAR test/challenge where such aspect is described below. A skilled reader will still further recognize that the targets described below for each NAR test/challenge, such as temperature, ozone concentration, etc. are provided as approximate, example targets, and may vary from any target/level stated in this document.

Cold Dry Air & Temperature Change Challenge Features

NAR environments within the chamber for the cold dry air and temperature change challenges may be facilitated by the air handling system of the present invention. During the cold dry air challenge, conditioned air (which may be at approximately 14±5° C., relative humidity of <15%) may be discharged from the velocity tubes and may be directed at the subject seating area at a velocity, such as approximately 5 ft/sec. During the temperature change challenge, warm air (which may be at approximately 35±5° C., 10-40% relative humidity) may be directed at the subject seating area, for example, such as at 5 ft/sec velocity, for a period of time, such as, for example approximately 1 hr, and then quickly switched to cold air (which may be at approximately 14±5° C., 10-40% relative humidity) which may be directed at the subject seating area, such as, for example at approximately 5 ft/sec velocity, for a period of time, such as, for example a further 1 hr (60 minutes). The levels of temperature, relative humidity and air velocity may be monitored by the environmental sensors within the air handling system. These levels may be reported, such as, for example by an automated element of the present invention. Such an automated element may be utilize a package of reporting software, such as, for example the ComfortVIEW™ software, or any other package and/or software for reporting purposes.

Calibration status of measuring devices may be achieved through a variety of means, such as the chilled mirror hygrometer and/or anemometer, which may be a wind anemometer. It is not necessary for all embodiments of the present invention to undertake a calibration process. Embodiments of the present invention that do undertake a calibration process may utilize one or more of several devices. The devices utilized may be specific to a specific NAR test/challenge.

For example, the hygrometer may be utilized as a primary dewpoint device that measures temperature and dewpoint using a chromium plated mirror and calculates relative humidity based on these measurements. This device may be highly sensitive and may measure temperature and dewpoint with ±0.2° C. accuracy. Alternatively, or additionally, the chilled mirror hygrometer may be a mobile device, allowing measurements to be taken at the subject seating area to ensure subjects are experiencing the desired conditions. A system, such as, for example the ComfortVIEW™ system, may also be utilized to provide temperature and relative humidity readings from the chamber. Such readings may be transmitted from sensors, such as, for example sensors that are duct-mounted in the return air supply. Further devices may be utilized that will measure temperature and relative humidity of the conditioned air and other conditions as these are experienced by the subjects at particular positions within the chamber, such as, for example at the seating area.

The present invention may be configured to address the following objectives: determining the ability of the system to maintain target parameters of temperature, relative humidity and air velocity temporally, over a typical challenge period, such as, for example one hour; determining the ability of the system to maintain target parameters of temperature, relative humidity and air velocity spatially at each of the seating positions to be used in NAR challenges; and determining the time required to switch between the warm air and cold air conditions for the temperature change challenge. Such determinations may be integrated into the method of the present invention. Additionally similar objections may be applied to each NAR test/challenge.

A variety of experiments and calibration means may be applied to measure target values and variability associated with each objective developed in the NAR temperature and CDA challenges. These may include: verifying the time to achieve a target relative to temperature and air velocity levels, and for the temperature change challenge the time to switch between the two conditions; verifying the spatial homogeneity of the temperature, relative humidity and air velocity between each of the seating positions; verifying the ability to maintain temporal homogeneity of temperature, relative humidity and air velocity over a typical challenge period; and determining the impact of the entry of the subjects into the chamber.

In one embodiment of the present invention, the cold dry air ("CDA") environment may target a particular temperature, such as, for example 14° C. (±3° C.), and relative humidity, such as, for example 10% (±5%). The conditions for the CDA may be selected based on literature identifying weather and temperature changes as major reported symptom triggers for NAR subjects (See: Shusterman D and Murphy M A (2007) Nasal hyperreactivity in allergic and non-allergic rhinitis: a potential risk factor for non-specific building related illness. *Indoor Air.* 17: 328-333). CDA nasal challenges have proven superior to histamine challenges to differentiate non-allergic rhinitis subjects from controls (See: Braat J P M, Mulder P G, Fokkens W J, Gerth van Wijk R and Rijntjes E (1998) Intranasal cold dry air is superior to histamine challenge in determining the presence and degree of nasal hyperreactivity in nonallergic noninfectious perennial rhinitis. *Am. J. Respir. Crit. Care Med.* 157: 1748-1755) suggesting that response to CDA is a defining phenotype of NAR. Also, nasal provocation studies have demonstrated that CDA but not warm moist air leads to an effect on the nasal mucosa (increased inflammatory mediator release and nasal epithelial cell shedding) (See: Togias A G, Naclerio R M, Proud D, Fish J E, Adkinson N F, Kagey-Sobotka A, Norman P S and Lichtenstein L M (1985) *J. Clin. Invest.* 76: 1375-1381; and Cruz A A, Naclerio R M, Proud D and Togias A (2006) Epithelial shedding is associated with nasal reactions to cold, dry air. *J. Allergy Clin. Immunol.* 117: 1351-1358). Based on these observations, embodiments of the present invention may include a NAR test/challenge to examine the effect of cold dry conditions. In addition, the effect of changing from a normal environment outside the chamber to a cold dry environment may be evaluated as a secondary objective. For the CDA challenge, an air velocity, such as, for example 5 ft/sec (±3 ft/sec), may be targeted. A moderate air velocity of 5 ft/sec is comparable to that experienced at an occupant's face from an automobile ventilation system at the lowest fan settings (Cetero Research (2007). Unpublished data).

In addition to absolute extreme temperatures, rapid changes in temperature have been shown to cause increased nasal symptoms (blockage, rhinorrhea, itching) in rhinitic subjects compared to controls (See: Graudenz G S, Landgraf R G, Jancar S, Tribess A, Fonseca S G, Fae K C and Kalil J (2006) The role of allergic rhinitis in nasal responses to sudden temperature changes. *J. Allergy Clin. Immunol.* 118: 1126-1132). These studies involved the exposure of subjects in a controlled chamber environment to cold air (14° C.) for 30 minutes, an immediate change to warm air (26° C.) for 30 minutes and a repetition of this cycle twice more. Based on these findings, the present invention may incorporate a temperature challenge to evaluate the effect of rapid temperature change on NAR symptoms. The temperature change challenge may expose subjects to warm air for one hour, followed by a rapid change to cold air and exposure to cold air for one hour. The relative humidity may remain constant, such as, for example at 20%±10%, during these experiments. Target temperatures may be achieved by the present invention, such as, for example 40° C.±3° C. for the warm air component and 14° C.±3° C. for the cold air component. A moderate target air velocity, such as, for example of 5 ft/sec (±3 ft/sec), may be utilized for both the warm air and cold air components.

| | | | |
|---|---|---|---|
| Cold Dry Air | 14° C. (±5° C.) | 10% (0 to 15%) | 5 ft/sec (±3 ft/sec) |
| Temperature Change - Warm Air | 35° C. (±5° C.) | 20% (10 to 40%) | 5 ft/sec (±3 ft/sec) |
| Temperature Change - Cold Air | 14° C. (±5° C.) | 20% (10 to 40%) | 5 ft/sec (±3 ft/sec) |

The present invention may be focused upon inducing rhinitis symptoms, and as a consequence the target conditions may be for subjects' faces only and not for the room conditions generally, or the conditions experienced by other parts of the subjects' bodies. In order to maximize exposure of conditioned air to subjects' faces and thus increase the probability of rhinitis symptoms, the velocity tubes may be directed specifically towards the head height of the front row of seating. As such, conditions may only be validated at particular positions within the chamber, such as, for example front row seating.

The method of the present invention may require a number of subjects to be within the chamber simultaneously. Subjects may be acclimatized to room temperatures prior to entering the chamber. The chamber may have the capacity to hold a particular number of subjects, such as, for example a maximum of eight subjects, as well as space designated for efficacy and safety assessments. In order to confidently provide a clinical model in which all subjects experience identical conditions, the spatial homogeneity within the chamber may be evaluated through a validation process. The experiments of a validation process may test the spatial uniformity of the temperature, relative humidity and air velocity. The environmental conditions may be tested at each subject position and spatial uniformity may be defined in accordance with set criteria.

Human beings release moisture into the environment through a number of mechanisms including surface evaporation from the skin and breathing. The impact of released moisture from human subjects, as well as the process of door opening to allow subject entry, on the environmental conditions within the chamber may be determined during a validation process. For example, entry and seating within the chamber of eight subjects has been determined in a prior study to increase the relative humidity level in a low humidity environment by approximately 5% which returned to within specifications in approximately 16 minutes. Criteria integrated into the method of the present invention may be based on such findings or other validation means, causing the persons conducting the challenge to select to allow for a time interval of re-equilibration of 20 (±10) minutes. Many variables can affect such criteria, including entry and exit of the maximum number of subjects on the temperature, relative humidity and air velocity. These may be assessed, evaluated and incorporated into the test/challenge method.

For example, in one embodiment of the present invention the following method may be applied to the cold-dry air and/or temperature NAR test:

1. Setting the target temperature, relative humidity and air velocity for the air handling system as necessary to achieve the target levels necessary to evoke a NAR trigger.
2. Starting the base air handling and velocity tube systems.
3. Recording temperature and relative humidity measures, such as provided by a chilled mirror hygrometer and a rotating vane anemometer, at regular intervals, such as, for example every 10 minutes, until the target levels for temperature and relative humidity are reached (within any defined respective variability). Measures, for example those by the chilled mirror hygrometer and the rotating vane anemometer, can be made in the airstream for a particular seating position in the front row as a representative position for the front row.

4. Once the target levels have been achieved, continuing to record measurements at regular intervals, such as, for example every five minutes, for a minimum number of measurements, such as, for example three measurements, to ensure a stable environment has been achieved.
5. Allowing entry of subjects into the chamber and have the subjects seated in the seating area.
6. Recording temperature and relative humidity, using the air handling system and the independent sensors, at regular intervals, such as, for example every two minutes, until the target levels have been re-attained. Record the time required for re-equilibration of each of temperature and relative humidity. Once all levels are re-attained, continue measurements at regular intervals, such as, for example, every five minutes for a set number of measurements, such as three measurements, to ensure conditions are stable.
7. Removing the subjects from the room.
8. Recording temperature and relative humidity at regular intervals, such as, for example every two minutes. Continue recording until target levels have been maintained for a set number of consecutive measurements, such as, for example three consecutive measurements.
9. The temperature and relative humidity measured with the chilled mirror hygrometer may each return to target levels, such as, for example within 20±10 minutes of subject entry or exit.

A skilled reader will recognize alternatives to this procedure may be applied by the present invention and that a procedure that is the same or similar to the one described herein may be applied to other NAR tests/challenges.

Following conduct of the CDA and temperature challenges, data may be analyzed and presented in a report. This report may describe a variety of findings of the tests in a variety of forms.

Ozone Challenge Specific Chamber Features

NAR subjects often report components of environmental pollution as a trigger of their nasal congestion and rhinorrhea. Atmospheric ozone is a major constituent of environmental air pollution and increased levels of atmospheric ozone have been shown to lead to a number of health issues, including damage to the nasal mucosa and increased inflammation in the upper respiratory tract (See: Pacini S, Giovannelli L, Gulisano M, Peruzzi B, Polli G, Boddi V, Ruggiero M, Bozzo C, Stomeo F, Fenu G, Pezzatini S, Pitozzi V, and Dolara P (2003) Association between atmospheric ozone levels and damage to the nasal mucosa in Florence, Italy. *Environ. Mol. Mutagen.* 42:127-135). In addition to atmospheric ozone pollution, indoor air quality is affected by ozone produced by mechanical devices such as copy machines and indoor air purifiers (See: Bernstein J A, Alexis N, Bacchus H, Bernstein I L, Fritz P, Horner E, Li N, Mason S, Nel A, Oullette J, Reijula K, Reponen T, Seltzer J, Smith A, and Tarlo S M (2007) *J. Allergy Clin. Immunol.* In press).

A number of studies have examined the effects of ozone exposure in a chamber setting thus providing guidelines for acceptable experimental exposure conditions. Pre-exposure to moderate ozone levels (0.5 ppm for 4 hr) prior to allergen challenge resulted in an increase in upper and lower respiratory symptoms and in nasal neutrophil and eosinophil levels (See: Bascom R, Naclerio R M, Fitzgerald T K, Kagey-Sobotka A, and Proud D (1990) Effect of ozone inhalation on the response to nasal challenge with antigen in allergic subjects. *Am. Rev. Respir. Dis.* 142: 594-601); whereas pre-exposure to low levels of ozone (0.12 or 0.2 ppm for 1 hour) prior to allergen challenge produced little effect on respiratory symptoms (See: Ball B A, Folinsbee L J, Peden D B, and Kehrl H R (1996) Allergen broncoprovocation of subjects with mild allergic asthma after ozone exposure. *J. Allergy Clin. Immunol.* 98: 563-572; and Chen L L, Tager I B, Peden D B, Christian D L, Ferrando R E, Welch B S and Balmes J R (2004) Effect of ozone exposure on airway response to inhaled allergen in asthmatic subjects. *Chest.* 125: 2328-2335), thus demonstrating the importance of adequate levels of ozone to see clinically relevant results. However, these studies do provide evidence to the experimentally acceptable exposure limits for ozone.

As ozone is a common indoor air pollutant, specific exposure limits have been set. The Health Canada short term exposure limit for ozone in indoor air is ≤0.12 ppm (≤240 $\mu g/m^3$) for a one-hour average concentration (See: Health Canada (1989). Exposure Guidelines for Residential Indoor Air Quality (1989) A report of the Federal-Provincial Advisory Committee on Environmental and Occupational Health. *Health Canada*). The U.S. Occupational Safety & Health Administration (OSHA) Permissible Exposure Limit (PEL) for ozone is 0.10 ppm for 8 hour/day and the ACGIH TLV is 0.2 ppm for less than 2 hour (See: US Department of Labor (2004). Chemical Sampling Information: Ozone (2004) U.S. Department of Labor, Occupational Safety & Health Administration. www.osha.gov).

The ozone challenge as an element of the present invention may be designed to simulate environmental pollution conditions commonly responsible for triggering nasal symptoms in NAR subjects. Given that higher ozone concentrations are required to elicit nasal symptoms, subjects may be exposed to the highest acceptable occupational exposure limit described by ACGIH, such as of 0.2 ppm for up to two hours. A skilled reader will recognize that the exposure limit may be set at varying levels for an ozone challenge applied as part of the present invention.

During the ozone challenge, an ozone generator may be operated within the chamber to generate levels of ozone. Target ozone levels may be identified for the challenge, such as, for example levels within the target range of 0.2±0.1 ppm. The level of ozone within the chamber may be monitored using an ozone detector. Monitoring may occur at defined times during the challenge at any stage of the challenge.

Measurement of the levels of ozone may be made with a portable ozone monitor. Calibration status of the ozone monitor may be undertaken. Any, all or none of the following experiments may be applied: experiments designed to determine the appropriate procedures and operational parameters necessary to achieve target levels of ozone spatially and temporally; experiments designed to determine the impact of door opening on the levels of ozone; experiments designed to determine the time required to saturate the exposure facility with target levels; and any other experiments relevant to a NAR test.

The ozone challenge may address the following objectives: determining the equipment settings required on the ozone generator to achieve target levels of ozone within the facility (0.2 ppm); determining acceptable and feasible range or tolerance of ozone levels; determine the ability of the equipment to maintain target levels of 0.2 ppm for one hour; determine the ability of the system to achieve spatial homogeneity of target levels of 0.2 ppm at each of the anticipated seating positions; determine the impact on the levels of ozone upon door opening; and determine the ability of the facility to maintain ozone levels upon failure of the ozone generator (a "worst-case" condition).

The present invention may involve a number of subjects being within the chamber simultaneously. The chamber may have the capacity to hold a number of subjects, such as, for example a maximum of four subjects, as well as space designated for efficacy and safety assessments. In order to minimize the exposure of conditioned air to subjects' faces and assess the effects of ozone on the subjects, the velocity tubes may not be enabled and subjects may only be seated in particular positions. Such positions may be validated as a step in the assessment of ozone effects on subjects.

In order to confidently provide a challenge environment in which all subjects experience identical conditions, the spatial homogeneity within the chamber can be evaluated as a step in the present invention. The experiments of such a validation objective may test the spatial uniformity of the target level of ozone. For example, the ozone levels may be tested at each subject position and assessed in accordance with a definition of spatial uniformity applied to the test. An example of such a step may involve collecting ozone levels with a photoionization detector at each targeted position within a chamber, such as seating position, at a set time interval over a period of time, such as, for example every 20 minutes for two hours.

Fragrance Challenge Features

Fragrances and perfumes are a commonly reported airborne trigger for NAR subjects. Although no studies have specifically examined the effect of exposure to fragrance or perfumes in a NAR population, much research has been conducted on the nasal effects of fragrances in persons with multiple chemical sensitivities or sick building syndrome. For example, Opeikun, RE, Smeets M, Sulewski M, Rogers R, Prasad N, Vedula U and Dalton P (2003) Assessment of ocular and nasal irritation in asthmatics resulting from fragrance exposure. *Clin. Exp. Allergy* 33: 1256-1265, examines ocular and nasal irritation in asthmatic subjects exposed to commercial air freshener in a controlled chamber. Challenges have also employed commercial perfumes, atomized in a chamber environment (See: Shim C and Williams M H (1986) Effect of odors in asthma. *Am. J. Medicine.* 80: 18-22; and Millqvist E and Lowhagen O (1996) Placebo-controlled challenges with perfume in subjects with asthma-like symptoms. *Allergy.* 51: 434-439). Olfactory research, such as that of Dalton P, Wysocki C J, Brody M J, Lawley H J. (1997) The influence of cognitive bias on the perceived odor, irritation and health symptoms from chemical exposure. Int. Arch. Occup. Environ. Health. 69:407-417, has identified the major chemical constituents responsible for common scents such as banana (amyl acetate), rose (phenylethyl alcohol), almond/cherry (benzaldehyde), wintergreen (methyl salicylate) and balsam (isobornyl acetate). Exposure of subjects to phenylethyl alcohol or methylethyl ketone (a common solvent), has been found to result in increased nasal resistance (See: Doty R L, Deems D A, Frye R E, Pelberg and Shapiro A (1988). Olfactory sensitivity, nasal resistance, and autonomic function in subjects with multiple chemical sensitivities. *Arch. Otolaryngol Head Neck Surg.* 114: 1422-1427).

Recent studies have used gas chromatography/mass spectroscopy to identify a number of different volatile organic compounds ("VOCs") in common consumer products including three types of air fresheners and three types of laundry products (See: Steinemann A C (2008) Fragranced consumer products and undisclosed ingredients. *Enviro Impact. Assess Rev*). These studies demonstrated that a common air freshener plug-in product contains 20 different VOCs, such as d-limonene, β-pinene, acetone, camphene and 3-hexen-1-ol. Previous olfactory chamber studies by Dalton have utilized photoionization detectors to monitor the levels of VOCs in the chamber (See: Dalton P (1996) Odor perception and belief about risks. *Chemical Senses.* 21: 447-458; and Dalton, P. (1999) Cognitive influences on health symptoms from acute chemical exposure. Health Psychology. 18(6):579-590). Following this same methodology, the levels of VOCs generated in the chamber of the present invention by a commercially available plug-in air freshener may be measured with a photoionization detector which detects VOCs. A skilled reader will recognize that this method is only one example of an element of a fragrance challenge of the present invention, and that other elements are possible.

In one embodiment of the present invention, fragrance levels may be created within the chamber through the use of fragrance dispensers, such as, for example commercially available fragrance dispersers. For example a commercially available air freshener plug-in used in residential, commercial and industrial environments to emit fragrance may be utilized. Air fresheners are composed of a large number of VOC and thus levels of VOCs are a good indicator of the level aerosolized fragrance. Such fragrance dispensers may be operated for a defined time prior to the entry of a subject into the chamber in order to achieve target fragrance levels. Purchased units may be tested for operation by plugging the units into electrical outlets and confirming expected operation by the observation of fragrance being generated or noise from the attached "fan" if applicable.

In one embodiment of the present invention, there may be 6 fragrance dispenser units in the room, 2 units (mixture of 2 fragrances) at each location marked "P" so that subjects are equally surrounded by the fragrance and volatile organic compounds released from the units. A skilled reader will recognize that other configurations of fragrance dispenser units are also possible, as is other means of disseminating fragrances in the chamber.

Fragrance exposure may be monitored using a photoionization detector to measure the levels of VOCs, an identified component of commercially available fragrances. The level of fragrance may be maintained at a target level for the challenge, such as, for example at 6±3 ppm.

A NAR-fragrance challenge validation protocol may be developed to outline the experiments necessary to verify the ability of the facility to attain target levels of VOCs, as a measure of fragrance. The NAR-Fragrance Challenge validation protocol may outline the specific objectives and experiments to be performed to verify that the facility can achieve the target levels of fragrance, as measured by levels of VOCs. The following experimental design may be followed for this purpose: verify time to achieve target levels of VOCs; verify the spatial homogeneity of the levels of VOCs at each of the seating positions; verify the impact of door opening on the levels of VOCs; and verify the ability to maintain temporal homogeneity of the levels of VOCs over a challenge period, such as, for example of 30 minutes.

In one embodiment of the present invention a multi-challenge chamber configuration may be utilized for the fragrance challenge. The multi-challenge chamber configuration may be of several types, configurations and sizes. For example, the multi-challenge chamber configuration may be approximately 40 feet by 8 feet, comprised of three separate rooms. The fragrance challenge room (approximately 8 feet by 8 feet) and irritant challenge room (approximately 12 feet by 8 feet) may be at either ends of the temporary exposure facility with a common waiting room in the middle (approximately 20 feet by 8 feet). A skilled reader will recognize other sizes and layouts of a multi-chamber configuration are possible in accordance with the present invention. The necessary heat and fresh air to the rooms may be supplied by a dedicated heating, ventilation, and air conditioning system located at each end of the temporary exposure facility. The seams of the walls and doors in the challenge rooms may be sealed to minimize cross-contamination between the challenge rooms and the waiting room. Within the challenge rooms and waiting areas of the chamber there may be designated areas for seating for a subject. The fragrance challenge room and the irritant challenge room may not have a NAR trigger disseminated in each and/or be run at the same time, to minimize cross-contamination of the NAR triggers in the waiting area.

The fragrance room in the multi-challenge chamber configuration may target a level, such as, for example of 6±3 ppm of VOCs as measured at each of the seating positions in ambient temperature, such as, for example 22° C.±5° C. If plug-in units are utilized the VOC emissions from the plug-in units may be verified at approximately 1 inch away from the units using a photoionization detector as well as the speed of the fans attached to the units using a digital phototachometer. The ability of the chamber to achieve and maintain the chosen target conditions can be critical to the successful completion of the validation process and the conduct of future clinical trials. It may be possible to challenge two or more subjects at a time in the chamber. The maximum exposure duration may be 30 minutes for the fragrance challenge. Therefore, the chamber can be tested for efficacy by establishing its ability to maintain desired conditions over a 30 minute period at the seating positions. A skilled reader will recognize that this is but an example, and that other fragrance room parameters and targets may be applied.

During the conduct of the NAR test door opening may be a necessary occurrence as subjects enter and exit the room. A door opening causes potential for loss of fragrance to the environment external to the chamber. For example, opening the door of the chamber may decrease the level of VOC at seating position #1 located in front of the door by 1±0.5 ppm compared to seating position #2. The data acceptance criteria may be selected to allow for a time interval of re-equilibration of 5±3 minutes.

Irritant Challenge Features

Irritants are one of the most frequently reported triggers for NAR subjects. In particular, household cleaning products, and by association their chemical irritants, have been identified by NAR subjects as strong triggers. One commonly used household cleaner is acetic acid. Studies examining acute effects of exposure to acetic acid vapours demonstrated that exposure to 5 or 10 ppm for 2 hours in a chamber environment produced nasal symptoms including nasal discomfort and runny nose (See: Ernstgard L, Iregren A, Sjogren B and Johanson G (2006) Acute effects of exposure to vapours of acetic acid in humans. *Toxicology Letters*. 165: 22-30). Similarly, exposure of seasonally allergic rhinitis subjects to 15 ppm of acetic acid vapour for 15 minutes, resulted in an increase in nasal airway resistance compared to baseline values (See: Shusterman D and Tarun A (2005) Seasonal Allergic Rhinitic and normal subjects respond differentially to nasal provocation with acetic acid vapor. *Inhalation Toxicology*. 17: 147-152). Interestingly, normal (non-rhinitic) subjects did not exhibit increased nasal airway resistance in response to acetic acid exposure, suggesting that rhinitic subjects may have increased susceptibility to the nasal effects of irritants.

Given that acetic acid is an industrial solvent, clear occupational exposure limits have been determined by various regulatory agencies. The Threshold Limit Value—Short Term Exposure Level (TLV-STEL) identified by the American Conference of Government Industrial Hygenists (ACGIH) is 15 ppm for 15 minutes (US Dept. of Labor, 2007). The Threshold Limit Value-Time Weighted Average (TLV-TWA) is 10 ppm, which is the limit for average exposure based on an 8 hour day and 40 hour/week schedule (See: US Department of Labor (2007). Chemical Sampling Information: Acetic Acid (2007) U.S. Department of Labor, Occupational Safety & Health Administration. www.osha.gov). Exposure conditions utilized in the present invention may be set so as not to exceed these occupational exposure limits.

To facilitate the irritant challenge several elements may be incorporated into the chamber. These elements may include an acetic acid dispenser unit and an acetic acid monitor. A skilled reader will recognize that other elements may be utilized to disperse and monitor irritants utilized in the irritant challenge.

An acetic acid dispenser unit may facilitate the aerosolizing of an acetic acid using a vaporizing method. The liquid acetic acid (4-8%) may be placed in a container which is slowly warmed to produce a vapor to saturate the chamber. The unit may be placed against the wall with the door as far away from the subjects seating area as possible so that the subjects are exposed to the appropriate level of aerosolized acetic acid saturating the room, rather than the vapors.

An acetic acid monitor, such as, for example Draeger-Tubes®, may be used to determine the concentration of aerosolized acetic acid throughout the validation process. Draeger-Tubes® are one-use glass vials filled with a chemical that undergoes a colorimetric reaction in response to the gas of your choice. Specific tubes are available for detected of acetic acid vapour. A calibrated 100 ml sample of air may be drawn into the tubes using the Draeger Accuro®-pump. If the targeted gas vapour, in this case acetic acid, is present the chemical reagent in the tube changes colour and the length of the colour change indicates the measured concentration.

The disperser unit may be able to achieve a level of 15 ppm in approximately 1 hour and to maintain a level of 15±5 ppm for almost 3 hours, exceeding the typical challenge period of 15 minutes. During the Irritant Challenge, acetic acid may be aerosolized to create an exposure level of 15 ppm in the chamber. Subjects may be exposed during each challenge for 15 minutes. In order to verify that target levels can be maintained constantly over the test period, the temporal homogeneity of the levels of aerosolized acetic acid may be verified at seating positions.

During the conduct of the irritant challenge door opening may be a necessary occurrence to facilitate the entry and exit of subjects and thus there is the potential for loss of aerosolized acetic acid to the environment external to the chamber wherein the NAR trigger is disseminated. The impact of door opening for the entry or exit of subjects may be minimal and a time interval of re-equilibration, such as, for example of 5±3 minutes, may be applied in the method of the present invention.

The exposure conditions for the irritant challenge may utilize acetic acid and may be selected to elicit a nasal response while not exceeding the occupational exposure limits. The irritant challenge may utilize aerosolized dilute acetic acid to mimic irritant levels typically experienced from household cleaning products. For example, during the irritant challenge, acetic acid may be atomized to create an exposure level of 15 ppm and subjects will be exposed for 15 minutes.

The irritant challenge may involve the use of aerosolized acetic acid to mimic household irritants that are a common trigger for NAR subjects. The target levels of irritant, aerosolized acetic acid, may be created using an atomizer/vaporizer which aerosolizes liquid acetic acid to a desired concentration, such as, for example of 15±5 ppm. The levels of acetic acid may be monitored throughout the challenge using a detector, such as, for example single-use colorimetric tubes specific for the detection of acetic acid vapour. A skilled reader will recognize that other types of irritants, target levels, and time durations may be applied in the present invention than those specifically stated in this document.

The equipment to be utilized in the irritant challenge may include an atomizer aerosol generator. Calibration status of measuring devices such as the Draeger-Tubes® and Draeger Accuro®-pump may also be undertaken. An irritant challenge verification process may involve experiments designed to determine the appropriate procedures and operational parameters necessary to achieve target levels of aerosolized acetic acid spatially and temporally, as well as the impact of door opening on the levels of aerosolized acetic acid, and the time required to saturate the exposure facility with target levels. A skilled reader will recognize that other devices, calibration processes and/or verifications processes may be applied by the present invention.

In one embodiment of the present invention the following objectives may be addressed: determining the equipment settings required on the atomizer to achieve target levels of aerosolized acetic acid; determining acceptable and feasible range or tolerance of irritant atomization; determining the ability of the equipment to maintain target levels, such as, for example of 15 ppm over 15 minutes; determining the ability of the system to achieve spatial homogeneity of target levels at each of the anticipated seating positions; determining the impact on the levels of aerosolized acetic acid upon door opening; and determining the ability of the facility to maintain aerosolized acetic acid levels upon failure of the atomizer (a "worst-case" condition). A skilled reader will recognize that other objectives may be applied to the present invention.

In one embodiment of the present invention a multi-challenge chamber configuration may be utilized for the irritant challenge as well as the fragrance challenge. The multi-challenge chamber configuration may be of varying types, sizes and configurations. For example, the multi-challenge chamber configuration may be approximately 40 feet by 8 feet, comprised of three separate rooms. The fragrance challenge room (approximately 8 feet by 8 feet) and irritant challenge room (approximately 12 feet by 8 feet) may be at either ends of the temporary exposure facility with a common waiting room in the middle (approximately 20 feet by 8 feet). The necessary heat and fresh air to the rooms may be supplied by a dedicated heating, ventilation, and air conditioning system located at each end of the temporary exposure facility. The seams of the walls and doors in the challenge rooms may be sealed to minimize potential cross-contamination between the challenge rooms and the waiting room. Within the chamber challenge rooms there may be a designated area for seating for at least one subject. The irritant challenge room and the fragrance challenge room may not have a NAR trigger disseminated in each and/or be run at the same time, to minimize cross-contamination of the triggers in the waiting area.

Multi-Challenge Chamber Configuration

Figure 2:
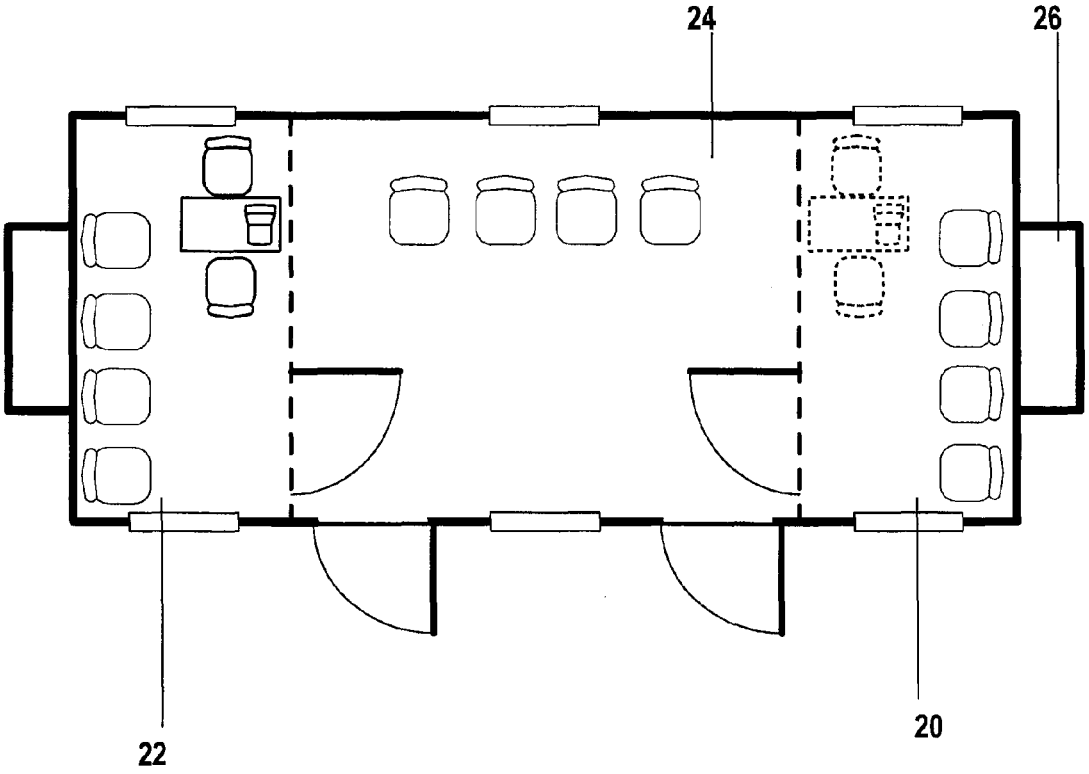
FIG. 2 is a top view of a multi-challenge chamber configuration.

As described above, the present invention may incorporate a multi-challenge chamber configuration. Such a configuration may incorporate multiple test/challenge exposure rooms and other rooms within a single chamber space. The multi-challenge chamber configuration may be used for multiple challenges in order to allow for quick and efficient creation of challenge environments in a manner that eliminates any cross-contamination between the challenge conditions. As described herein it may be possible to apply the multi-challenge chamber configuration to facilitate the irritant and fragrance challenges, as shown in FIG. 2. A skilled reader will recognize that a multi-challenge chamber configuration may be utilized for other challenge combinations and may incorporate a means of facilitating two or more NAR test/challenge environments within the chamber.

The multi-challenge chamber configuration may be an embodiment of the chamber of the present invention. The multi-challenge chamber configuration may incorporate multiple NAR test/challenge exposure rooms as well as other areas. As shown in FIG. 2, an embodiment of a multi-challenge chamber configuration may be approximately 40 feet by 8 feet and may be comprised of three separate rooms, such as an irritant challenge room 20, a fragrance challenge room 22 and a common waiting/assessment room 24. A dedicated heating, ventilation and air conditioning system may supply necessary heat and fresh air to the exposure rooms and waiting area. In one embodiment of the present invention, such a heating, ventilation and air conditioning system 26 may be located beside an exposure room. Cross-exposure between the test/challenge exposure rooms and other rooms, such as the waiting room, may be minimized by sealing the return air inlets in the test/challenge exposure rooms.

A skilled reader will recognize that a variety of configurations of exposure rooms and other rooms may be incorporated into a multi-challenge chamber configuration.

Reports, Audits and Statement of Audits

A variety of reports, audits and statement of audits may be generated by the present invention. These may reflect any of the following as an example: subject information, challenge results; challenge comparisons; series of NAR challenges information; groups of subjects results; any combination of the aforementioned; and any other information. The information utilized in the reports, audits and statement of audits may be retrieved from several sources, including electronic or digital data, such as, for example data stored in a database or another electronic storage means. Said database or electronic storage means may be connected to an element of the chamber of the present invention whereby data is transferred directly from the element of the chamber to the database, or data may be manually entered into the database, such as, for example through a computer or other device (such as, for example a personal data device). Alternatively, any combination of automatic transfer and manual entry may utilized to populate the database or enter data in the electronic storage means.

For example, a NAR Facility Validation Report may be generated which may describe the results of the individual Validation Protocols and experimentation. The success of each of the Validations may be evaluated independently according to adherence of the Data Acceptance Criteria described in the individual Validation Protocols. The utility of each of the challenges in the NAR Facility may be discussed, as well as the overall success of the NAR Facility Validation.

The NAR Facility Validation Report may be audited by a Quality Assurance (QA) Department after the validation and QA will issue a final Statement of Audit once complete.

Data Capture Systems

All data collected from the present invention may be documented in various forms, logs and source materials. For example, data may be recorded in compliance with Good Documentation Practices and may be subjected to review and internal audits from the QA Department.

As an additional example, an equipment log book may be set up for each piece of equipment to be used in the validation process. Operational manuals and calibration documents for all equipment may be stored in the equipment log books. A detailed summary of all the equipment maintenance and service that has occurred on all the equipment may be documented in the equipment log books as well. All the equipment that will be used in the validation may be subject to a documented maintenance schedule.

As described above, data may be captured and stored manually or in any electronic and/or digital means, including in a computer, database, personal data device, or any other data storage means.

The following logs and forms are examples of reports that may be used to capture and record data during the validation process. A skilled reader will recognize that other reports and data capture systems may be utilized in accordance with the present invention.

Temperature and Relative Humidity Log

A log may be developed to record the temperature and relative humidity of the chamber, measured using the internal computerized sensors, such as, for example ComfortVIEW™, and the independent temperature and relative humidity sensor, such as, for example a chilled mirror hygrometer.

Air Velocity Log

A log may be developed to record the air velocity within the chamber. This log may include the time and air velocity at each subject seating position, as well as other measurements deemed necessary. This log may be incorporated as part of the Temperature and Relative Humidity Log if appropriate.

Areosolized Acetic Acid Log

A log may be developed to record the levels of aerosolized acetic acid within the exposure facility. This log may include the time, location of sampling and levels of aerosolized acetic acid, as well as other measurements deemed necessary.

Areosolized Fragrance Log

A log may be developed to record the levels of aerosolized fragrance within the exposure facility. This log may include the time, location of sampling and levels of aerosolized acetic acid, as well as other measurements deemed necessary.

Ozone Level Log

A log may be developed to record the levels of ozone within the exposure facility. This log may include the time, location of sampling and levels of ozone, as well as other measurements deemed necessary.

EXAMPLE

NAR Test Series Study

An example of a NAR test is provided as follows. This example outlines a study designed to investigate a number of different exposure conditions/triggers of NAR in a chamber model, in accordance with the present invention. A skilled reader will recognize that this study is provided as an example and that other methods and chambers of the present invention are possible.

Challenge Visits

Subjects will return at least three days after a medical screening visit for the first of their series of challenge visits. At each challenge visit subjects will be exposed to one of the following triggers: cold dry air, temperature change, ozone, irritant or fragrance. The exposure groups will be spaced out in order to allow sufficient time for resolution of any symptoms. All subjects will be exposed to all triggers regardless of their reported historical sensitivity. Subjects will first be exposed to the trigger that they rank most bothersome, followed by exposure to remaining triggers based on a predetermined common sequence. Each of the exposure challenges will be separated by at least three days.

The details of each exposure challenge and the rationale for the selection of conditions are as follows:

Temperature Change Challenge

Subjects will enter the chamber being maintained at warm air conditions (a maximum of 40° C.). Subjects will have their faces exposed to the warm air for approximately one hour after which the conditions of the chamber will be rapidly converted to cold air (a minimum of 4° C.). Subjects will be exposed to cold air for approximately one hour. Both the warm air and cold air will be directed at subjects' faces at a moderate velocity (approximately 5 feet/second).

Subjects will be required to attend the temperature change challenge at least three days after their previous visit. Several steps may be performed during the temperature change challenge including the following. (1) Subjects may be queried for changes in health since last visit and the use of concomitant medication. (2) Concomitant medication use may be assessed as will eligibility with respect to the required exclusion periods. The subject must not have needed prohibited medications for the required exclusion periods. (3) acoustic rhinometry procedures will be performed prior to entry into the chamber. (4) Nasal biomarker collection will be performed prior to entry into the chamber, but after acoustic rhinometry procedures have taken place and again upon completion of the post-chamber acoustic rhinometry measurement. (5) Subject will enter the chamber under warm air conditions. Subjects will have their faces exposed to the warm air for approximately one hour. (a) Total Nasal Symptom Score ("TNSS") will be obtained from the subject prior to entry into the chamber and at 5, 10, 15, 20, 25, 30, 45 and 60 minutes post-chamber entry. (b) VAS measures will be collected immediately prior to achieving cold air conditions and at 30 and 60 minutes post-entry. (c) Nasal secretions will be collected on pre-weighed tissues during the warm air conditions. (d) chamber Quality of Life measures will be taken prior to and after warm air conditions. (e) acoustic rhinometry measures will be taken at approximately 30 minutes post-chamber entry. (f) Upon completion of the 60 minute warm air TNSS diary card, acoustic rhinometry will be performed on the subject. (6) Upon completion of the 60 minute warm air exposure, the chamber will be converted to cold air conditions. (a) Interim TNSS diary cards will be obtained in approximately five minute intervals from the subject during the temperature conversion process until the cold air conditions have been achieved. (b) TNSS will be obtained from the subject under cold air conditions at 5, 10, 15, 20, 25, 30, 45 and 60 minutes post-temperature change. (c) VAS measures will be collected immediately prior to achieving cold air conditions and at 30 and 60 minutes post-entry. (d) Nasal secretions will be collected on pre-weighed tissues during the cold air conditions. (e) Chamber Quality of Life measures will be taken prior to and after cold air conditions. (f) acoustic rhinometry measures will be taken at approximately 30 minutes post-cold air condition initiation. (g) Upon completion of the 60 minute cold air TNSS diary card, acoustic rhinometry will be performed on the subject. (7) Upon exit of the chamber, the subject will complete post-chamber symptom assessments every 10 minutes for 30 minutes prior to leaving the clinic. (8) Subject will be queried for changes in health prior to dismissal from the clinic Ozone Challenge Subjects will be exposed to a safe concentration of ozone for up to two hours. This level will not exceed the Threshold Limit Value ("TLV") of 0.2 parts per million ("ppm") described by the American Conference of Government Industrial Hygenists ("ACGIH") as the concentration that is safe for exposures of less than two hours (US Dept. of Labor, 2004).

Subjects will be required to attend the ozone challenge at least three days after their previous visit. Several steps may be performed during the ozone challenge including the following. (1) Subjects may be queried for changes in health since last visit and the use of concomitant medication. (2) Concomitant medication use may be assessed as will eligibility with respect to the required exclusion periods. The subject must not have needed prohibited medications for the required exclusion periods. (3) acoustic rhinometry procedures will be performed prior to entry into the chamber and approximately 60 minutes after chamber entry. (4) Nasal biomarker collection will be performed prior to entry into the chamber, but after acoustic rhinometry procedures have taken place and again upon completion of the post-chamber acoustic rhinometry measurement. (5) Subject will enter the chamber and be exposed to ozone at a safe concentration for up to a maximum of two hours. (a) TNSS will be obtained from the subject prior to chamber entry and at 5, 10, 15, 30, 45, 60, 75, 90, 105 and 120 minutes post-chamber entry. (b) VAS measures will be collected prior to chamber entry and at 30, 60 90 and 120 minutes post-entry. (c) Nasal secretions will be collected on pre-weighed tissues during the chamber exposure. (d) chamber Quality of Life measures will be taken prior to and after chamber exposure. (e) Upon completion of the 120 minute TNSS diary card, acoustic rhinometry will be performed on the subject. (6) Subject will be queried for changes in health prior to dismissal from the clinic Irritant Challenge Subjects will be exposed to a safe concentration of aerosolized acetic acid for approximately 15 minutes. The exposure concentration will not exceed the Threshold Limit Value-Short Term Exposure Limit ("TLV-STEL") of 15 ppm, identified by the ACGIH as the concentration which is safe for a maximum exposure of 15 minutes (US Dept. of Labor, 2007).

Subjects will be required to attend the irritant challenge at least three days after their previous visit. Several steps may be performed during the irritant challenge including the following. (1) Subjects may be queried for changes in health since last visit and the use of concomitant medication. (2) Concomitant medication use may be assessed as will eligibility with respect to the required exclusion periods, as specified in the exclusion criteria. The subject must not have needed prohibited medications for the required exclusion periods. (3) acoustic rhinometry procedures will be performed prior to entry into the exposure facility. (4) Nasal biomarker collection will be performed prior to entry into the chamber, but after acoustic rhinometry procedures have taken place and again upon completion of the post-chamber acoustic rhinometry measurement. (5) Subject will enter the exposure facility to be exposed to an aerosolized acetic acid for approximately 15 minutes. (6) TNSS will be obtained from the subject prior to exposure facility entry and at 5, 10 and 15 minutes post-entry. (7) Visual Analog Scale ("VAS") measures will be collected prior to chamber entry and 15 minutes post-entry. (8) Nasal secretions will be collected on pre-weighed tissues during the chamber exposure. (a) Chamber Quality of Life measures will be taken prior to and after chamber exposure. (9) Upon completion of the 15 minute TNSS diary card, acoustic rhinometry will be performed on the subject. (10) Subject will be queried for changes in health prior to dismissal from the clinic.

Fragrance Challenge

Subjects will be exposed to a commercially available aerosolized fragrance at generally accepted levels for exposure for approximately 30 minutes.

During exposure challenges, subjects will be assessed for rhinitis symptoms using the TNSS. Subjects will have nasal patency assessed using acoustic rhinometry before and after exposure. Challenges of longer duration will have acoustic rhinometry performed at timepoints during the exposure. Subjects will also undergo a nasal secretion collection via filter paper to determine biomarker levels prior to and after exposure to the NAR trigger and nasal secretions will be collected and weighed.

Subjects will be required to attend the fragrance challenge at least three days after their previous visit. Several steps may be performed during the fragrance challenge including the following. (1) Subjects may be queried for changes in health since last visit and the use of concomitant medication. (2) Concomitant medication use may be assessed as will eligibility with respect to the required exclusion periods, as specified in the exclusion criteria. The subject must not have needed prohibited medications for the required exclusion periods. (3) acoustic rhinometry procedures will be performed prior to entry into the chamber. (4) Nasal biomarker collection will be performed prior to entry into the chamber, but after acoustic rhinometry procedures have taken place and again upon completion of the post-chamber acoustic rhinometry measurement. (5) Subject will enter the exposure facility to be exposed to an aerosolized fragrance for approximately 30 minutes. (6) TNSS will be obtained from the subject prior to chamber entry and at 5, 10, 15, and 30 minutes post-entry. (7) VAS measures will be collected prior to chamber entry and 30 minutes post-entry. (8) Nasal secretions will be collected on pre-weighed tissues during the chamber exposure. (9) Chamber Quality of Life measures will be taken prior to and after chamber exposure. (10) Upon completion of the 30 minute TNSS diary card, acoustic rhinometry will be performed on the subject. (11) Subject will be queried for changes in health prior to dismissal from the clinic.

Cold Dry Air Challenge ("CDA")

Subjects will be required to attend the CDA Challenge at least three days after their previous visit. Several steps may be performed during the CDA Challenge including the following. (1) Subjects may be queried for changes in health since last visit and the use of concomitant medication. (2) Concomitant medication use may be assessed as will eligibility with respect to the required exclusion periods. The subject must not have needed prohibited medications for the required exclusion periods. (3) acoustic rhinometry procedures will be performed prior to entry into the chamber and approximately 30 minutes after chamber entry. (4) Nasal biomarker collection will be performed prior to entry into the chamber, but after acoustic rhinometry procedures have taken place and again upon completion of the post-chamber acoustic rhinometry measurement. (5) Subject must be acclimatized to normal room temperature for at least 30 minutes prior to entry into the chamber. (6) Subject will enter the chamber to be exposed to cold dry air for approximately one hour. (a) TNSS will be obtained from the subject prior to entry into the chamber and then 5, 10, 15, 20, 25, 30, 45 and 60 minutes post-chamber entry. (b) VAS measures will be collected immediately prior to achieving cold air conditions and at 30 and 60 minutes post-entry. (c) Nasal secretions will be collected on pre-weighed tissues during the chamber exposure. (d) Chamber Quality of Life measures will be taken prior to and after chamber exposure. (e) Upon completion of the final diary card acoustic rhinometry will be performed on the subject. (f) Upon exit of the chamber, the subject will complete post-chamber symptom assessments every 10 minutes for 30 minutes. (7) Subject will be queried for changes in health prior to dismissal from the clinic.

Post-NAR Tests

The following provide example results derived from preliminary NAR tests. A skilled reader will recognize that such results are provided as an example only and do not limit the scope of the present invention.

General Results: All of the target conditions for the various challenges were achieved and maintained in a spatially and temporally uniform fashion. The static CDA challenge was maintained at <14° C., ≤15% relative humidity (RH), with air velocity <10 ft/sec for one hour. The second temperature challenge involved dynamic temperature conditions of 30-40° C., <40% relative humidity for one hour followed by a second hour at <14° C., <40% RH, both conditions with air velocity <10 ft/sec. The fragrance challenge utilized commercially available atomizers to achieve and maintain targeted Parts per Million (ppm) levels of volatile constituents for thirty minutes while the irritant challenge utilized aerosolized acetic acid and was validated to maintain safe, targeted ppm ranges for short time periods. The ozone challenge was designed to saturate a chamber with safe levels of ozone as measured in ppm in ambient temperature and was maintained for 2 hours. All testing was repeated in duplicate.

Conclusion: The NAR model is a novel, safe and well-controlled environment where NAR subjects can be consistently and reliably challenged with key environmental triggers in order to test the efficacy of putative NAR therapeutics.

Following the NAR tests further assessments may occur including the following.

Static and Dynamic Temperature Shift Regimes

The following is presented solely for purpose of providing an example of a static and dynamic temperature shift regime approach of the present invention and the results therefore. A skilled reader will recognize that this example does not limit the scope of the present invention.

Objectives: To assess if controlled application of cold dry air (CDA) in static or warm air/cold air (WA/CA) dynamic regimes results in significant increase in nasal symptoms as measured subjectively with diary card (DC) and visual analogue scale (VAS) and objectively with acoustic rhinometry.

Method: Subjects with a self-reported reaction to at least one NAR trigger and negative SPT for a panel of allergens were challenged with static (n=13) and dynamic (n=14) challenges to induce nasal symptoms. Static CDA challenge was 1 h CDA (<14° C., ≤15% RH, 5 ft/s). Dynamic WA/CA challenge was 1 h WA (30-40° C., <40% RH, 5 ft/s) immediately followed by 1 h CA (<14° C., <40% RH, 5 ft/s). Upon chamber entry, subjects rated total nasal symptom scores (TNSS) on DCs every 5 mins for 30 mins then every 15 mins to 1 h. VAS and acoustic rhinometry were completed every 30 mins. Subjects completed DC, VAS, and acoustic rhinometry at same time points during each of WA or CA conditions.

Results: Static CDA: DC: 38%, 77% & 92% of subjects had increased TNSS by 10, 30 & 60 mins respectively. VAS: 85% & 77% of subjects had increased symptoms by 30 & 60 mins respectively. acoustic rhinometry: 10/13 subjects had a 22% decrease (p=0.004) in mean cross-sectional area (MCA) from pre-chamber level by 30 mins; 6/13 had an 18% MCA decrease at 60 mins (p=0.02). Dynamic WA/CA: WA:DC: 36%, 43% & 50% of subjects' TNSS increased by 10, 30 & 60 mins respectively. VAS: 50% & 43% of subjects had increased symptoms by 30 & 60 mins respectively. acoustic rhinometry: MCA decreased 18% (p<0.005) from pre-chamber at 30 mins in 9/14 subjects and 21% at 60 mins in 11/14 subjects. CA:DC: 57%, 57% & 64% of subjects' TNSS by 10, 30 & 60 mins respectively. VAS: 43% & 64% of subjects' symptoms increased by 30 & 60 mins respectively. acoustic rhinometry: MCA decreased by 14% (p<0.0004) from pre-chamber level by 30 mins in 12/14 subjects and 11% (p<0.01) at 60 mins in 6/14 subjects.

Conclusion: This is the first demonstration in a chamber that static CDA challenge results in the consistent induction of significant nasal symptoms in NAR subjects. Challenging NAR subjects to CDA or other relevant NAR triggers using chamber provides robust clinical model to safely test putative NAR therapeutics and further elucidate mechanisms of NAR.

Study 1

A study was conducted utilizing the NAR chamber and involving a variety of NAR challenges, including a cold dry air challenge of 60 minutes, a temperature change challenge of 120 minutes total (60 minutes of warm temperatures and 60 minutes of cold temperatures), a fragrance challenge of 30 minutes, an irritant challenge of 15 minutes and an ozone challenge of 120 minutes.

Study 1 was conducted in the winter of 2009. Participants were identified as those who: did not have a history of seasonal allergic rhinoconjunctivitis; tested negative for a skin prick test; and reported a positive response to a NAR questionnaire. The participants were engaged in a series of five NAR challenges, each challenge being separated by a minimum of 3 days from the others.

A total of 37 participants were involved in Study 1, although of these only 36 engaged in the ozone challenge. In each NAR challenge the total nasal symptoms score (TNSS) was assed at various time points. The assessment including points on a scale of 0-3 for each of three evaluations (to a maximum of 9 points), the evaluations included nasal congestion, rhinorrhea and post nasal drip.

The minimal cross-sectional areas were also assessed during each NAR challenge. These assessments occurred at the mid-point of the challenge and post-challenge. An objective measure of an acoustic rhinometry (AcR) was utilized to assess nasal patency or degree of nasal congestion.

Participants were identified as TNSS responders if they had <20% of "0" or "negative" scores on their diary cards. Participants were identified as total nasal symptoms score non-responders if they had ≥80% of "0" or "negative" scores.

Participants were identified as AcR reponders if they had ≥10% decrease in their minimal cross-section areas in either left or right nostrils.

Figure 4A:
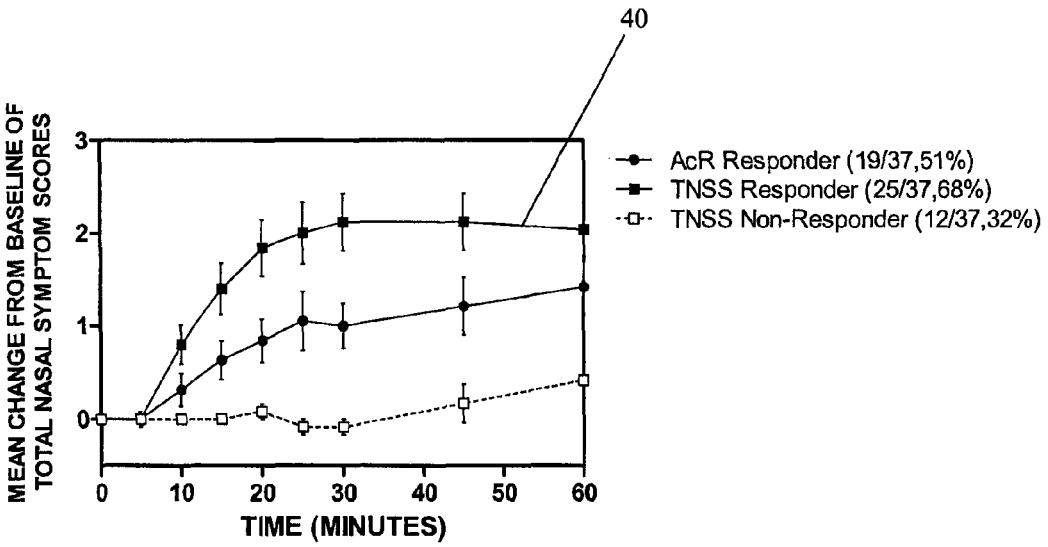
FIG. 4(*a*) is a graphical representation of results from a cold dry air challenge period of 60 minutes in accordance with Study 1 showing the increase in mean change from baseline of the total nasal symptom score of participants.
Figure 4B:
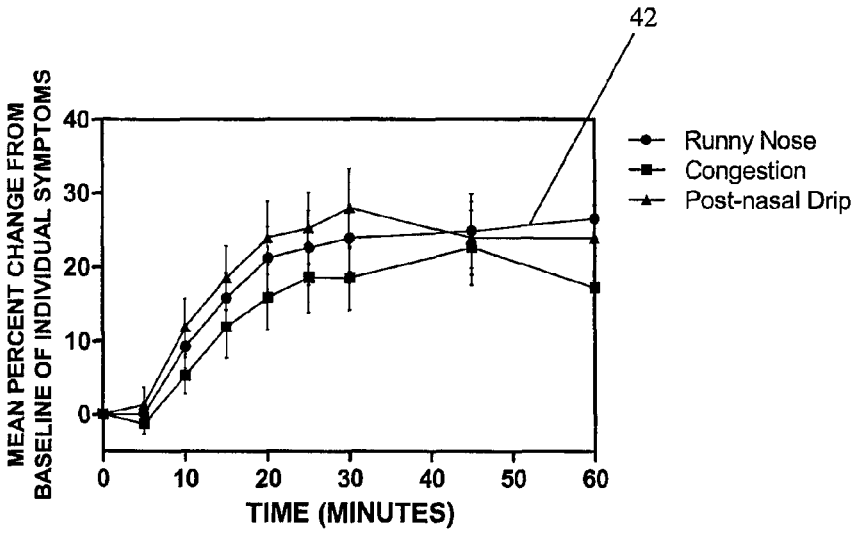
Figure 4C:
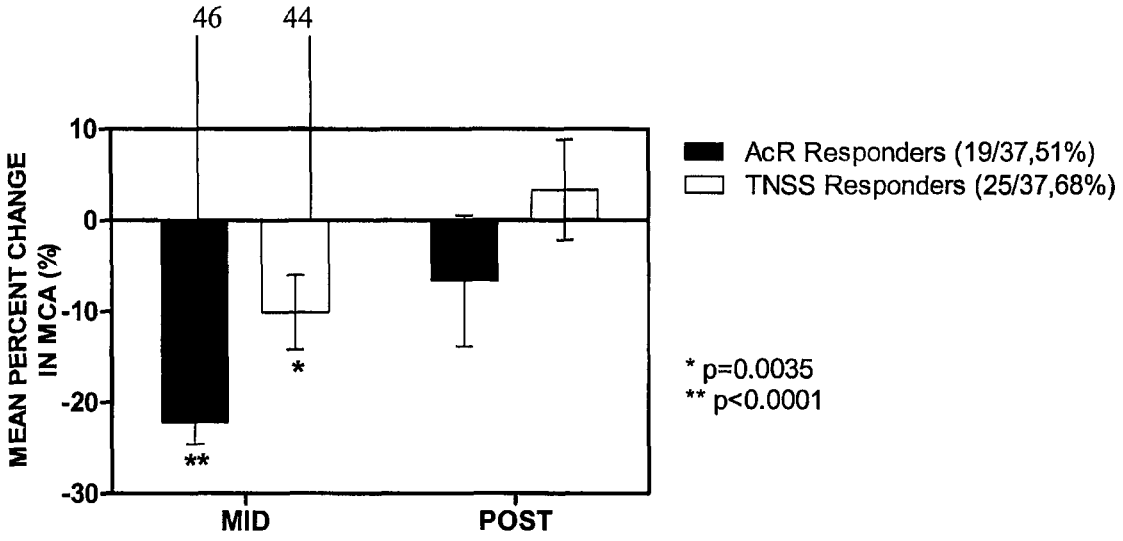

The results of these assessments are shown in FIGS. 4(*a*)-10. The overall result of Study 1 was that the majority of Non-Allergic Rhinitis participants responded with significant subjective nasal symptom increases as well as significant objection decreases in nasal patency with AcR to the NAR chamber and the NAR challenges. Notably, 22% of NAR pariticipants did not respond to any of the five triggers while other participants responded very specifically to one or more trigger challenges. No participant responded to all triggers. This indicates the specificity and utility of the NAR chamber method of the present invention as a model for the study of the NAR participants. The method and chamber of the present invention may be utilized to understand more about the NAR subject phenotype as well as to test putative anti-NAR therapeutics.

FIG. 4(*a*)-(*c*) depict the results of response to the cold dry air challenge by the participants over a challenge period of 60 minutes. In the course of this challenge the cold dry air is circulated and may be directed at the participants in the NAR chamber. The participants were exposed to the cold dry air within the NAR chamber.

FIG. 4(*a*) shows the subjective symptom response, which indicates a significant increase in the mean change from baseline of the TNSS of the TNSS and AcR responders which correspond to 68% and 51% of NAR participants respectively compared to the little to no change in symptoms in non-responders (32% of participants tested) occurring over the cold dry air challenge period of 60 minutes. The graph depicts that there was a significant increase of the mean change from baseline of TNSS in Nasal Symptom Responders 40 and AcR Responders. The response of Nasal Symptom Non-Responders was minimal.

FIG. 4(*b*) shows the significant increase in nasal symptom score, being the mean percentage change from baseline of individual symptoms focusing upon the Nasal Symptom responders of FIG. 4(*a*). Specifically three nasal responses are shown, runny nose, congestion and post-nasal drip. The runny nose response 42 is shown to be the most prevalent at the end of the 60 minute time period.

FIG. 4(*c*) shows the nasal patency of the Nasal Symptom responders and AcR responders of FIG. 4(*a*). The nasal patency was determined by measuring the minimal cross-sectional area at the mid-point of the 60 minute cold dry air challenge period (30 minutes) and at the end of the 60 minute cold dry air challenge period. The decrease in nasal patency of the responders at the mid-point of the cold dry air challenge was statistically significant for both the Nasal Symptom responders 44, at $p=0.0035$, and the AcR responders 46, at $p<0.0001$.

Figure 5A:
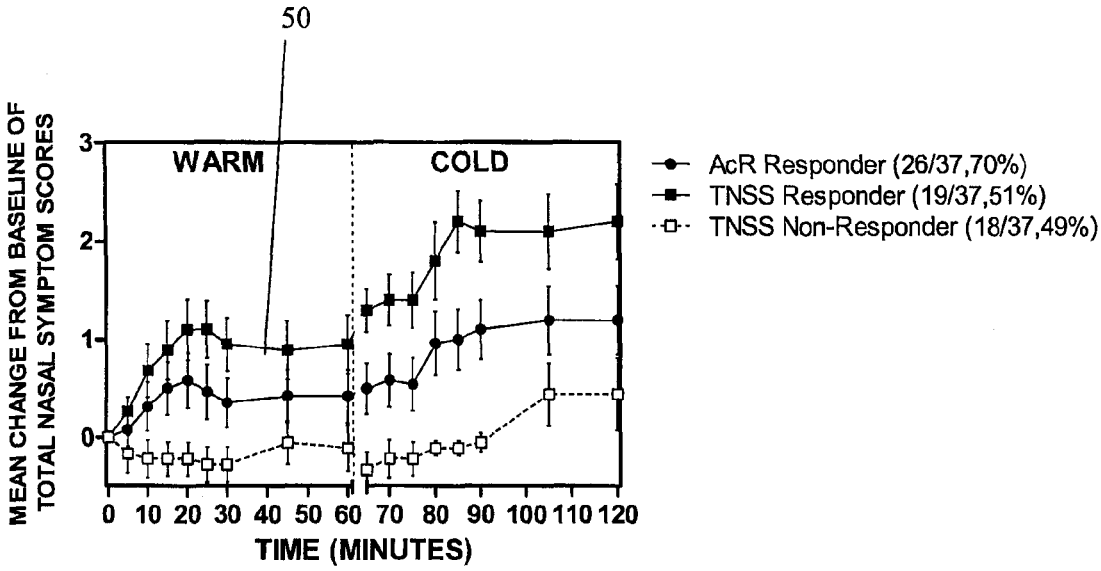
FIG. 5(*a*) is a graphical representation of the results of a temperature change challenge period of 120 minutes in accordance with Study 1 showing the increase in mean change from baseline of the total nasal symptoms score of participants.
Figure 5B:
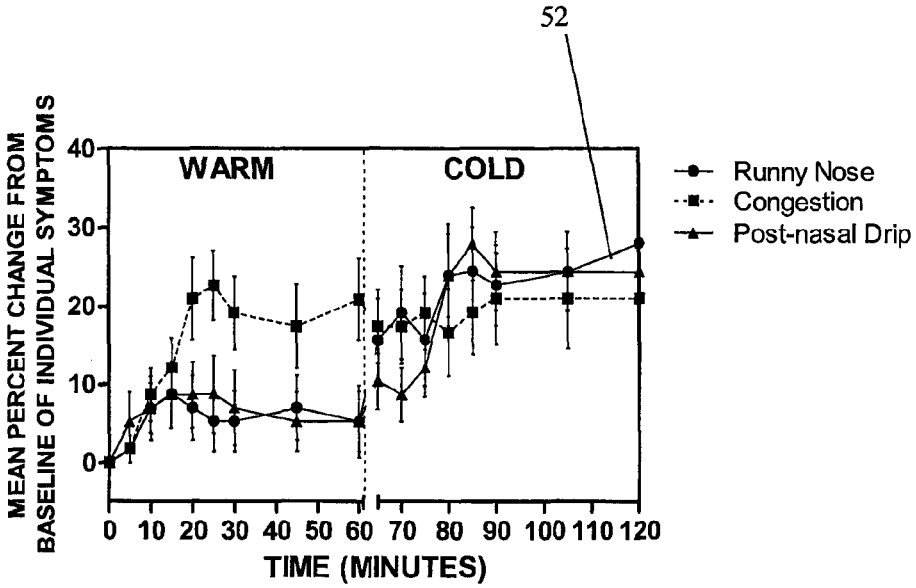
Figure 5C:
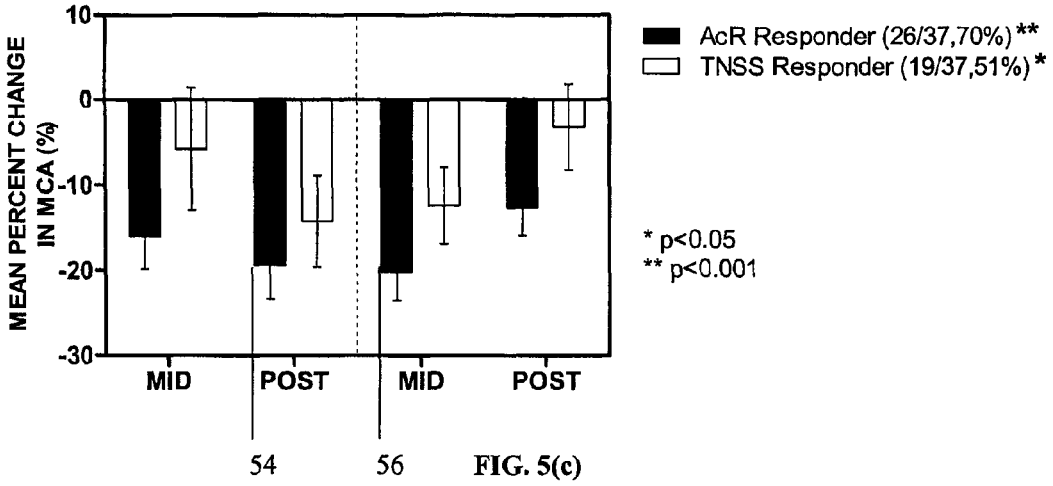

FIG. 5(*a*)-(*c*) depict the results of response to the temperature change challenge by the participants. In this challenge warm air circulated in the NAR chamber for the first 60 minutes of the 120 minutes of the challenge period and cold air circulated for the last 60 minutes of the challenge period. The participants were exposed to the warm air and the cold air within the NAR chamber.

FIG. 5(*a*) shows the diary cards, which indicate the mean change from baseline of the TNSS of the participants occurring over the temperature change challenge period of 120 minutes. The graph depicts that warm air induced approximately 1 unit change from the baseline of the TNSS for Nasal Symptom responders 50 and an increase of 2 units occurred in response to cold air. Notably, the same participants that responded to the cold air period of the temperature change challenge responded similarly in the cold dry air challenge. This may be interpreted as showing reproducibility of the cold air stimulus.

FIG. 5(*b*) shows the mean percentage change from baseline of individual symptoms focusing upon the Nasal Symptom responders of FIG. 5(*a*). Specifically three nasal responses are shown, runny nose, congestion and post-nasal drip. The runny nose response 52 is shown to be the most prevalent at the end of the 120 minute challenge period.

FIG. 5(*c*) shows the nasal patency of the Nasal Symptom responders and AcR responders of FIG. 4(*a*). The nasal patency was determined by measuring the minimal cross-sectional area at the mid-point of the each of the 60 minute warm air and cold air phases of the total 120 minute challenge. The greatest change in nasal patency was observed in the AcR responders at the end of the warm air period 54 (60 minutes of the total challenge period), at $p\leq0.001$, and at the mid-point of the cold air challenge 56 (90 minutes of the total challenge period), at $p\leq0.001$.

Figure 6:
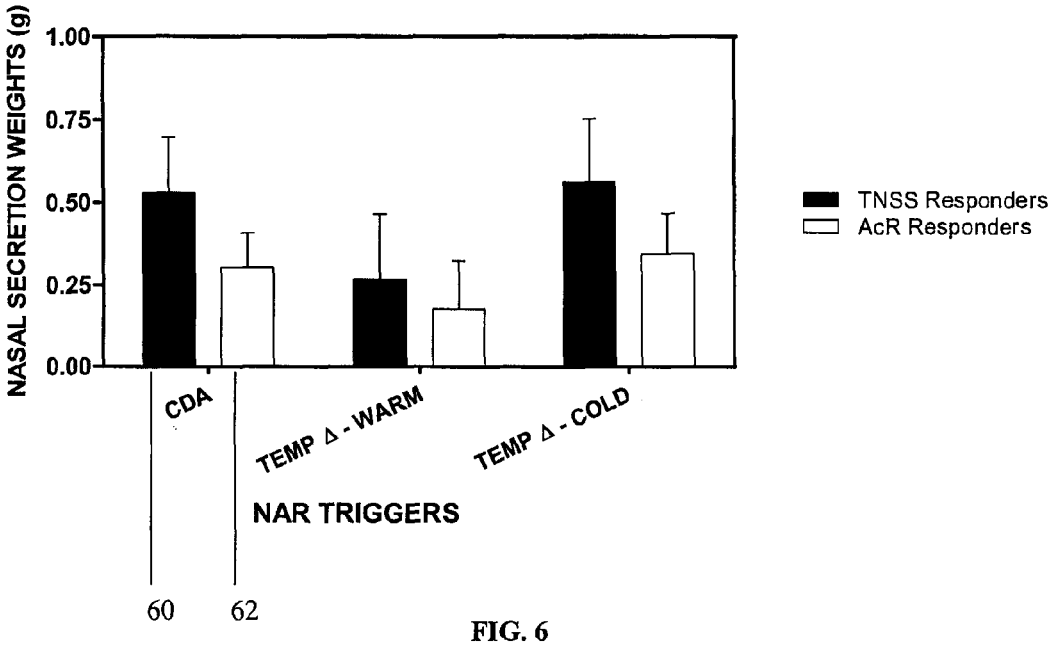
FIG. 6 is a graphical representation of the increase in nasal secretions collections for patients after the cold dry air and temperature change challenges of Study 1.

FIG. 6 shows the amount of nasal secretions collections from participants after the cold air challenge, the warm air phase of the temperature change challenge and the cold air phase of the temperature change challenge NAR challenges of Study 1. The collections are shown for the Nasal Symptom responders 60 and the AcR responders 62. The increase in nasal secretion amounts is consistent with increase rhinorrhea report by participants.

The reproducibility of the cold temperature challenge was seen between the cold temperature challenge was seen between the cold dry air challenge and the cold air phase of the temperature change challenge. These challenges, both involving cold air, induced the highest level of nasal secretions. This finding was consistent with higher rhinorrhea scored by the participants as shown in FIGS. 4(*b*) and 5(*b*). Warm air elicited less nasal secretion. This is consistent with increased nasal congestion and decreased rhinorrhea scored by participants as shown in FIG. 4(*b*).

Figure 7A:
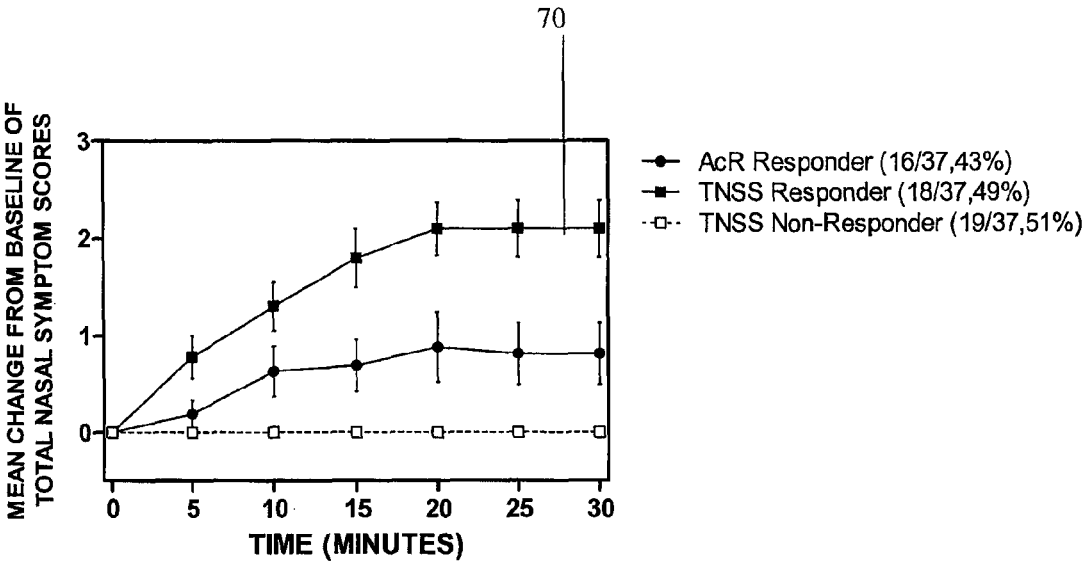
FIG. 7(*a*) is a graphical representation of the results of a fragrance challenge period of 30 minutes in accordance with Study 1 showing the increase in mean change from baseline of the total nasal symptoms score of participants.
Figure 7B:
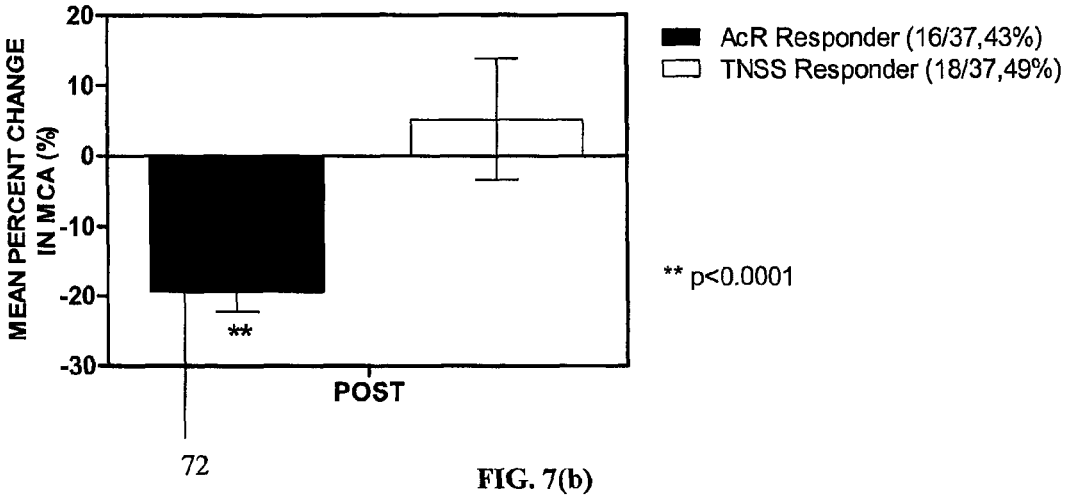

FIGS. 7(*a*)-(*b*) depict the results of response to the fragrance challenge by the participants. In this challenge fragrance circulated in the NAR chamber for a 30 minute challenge period. The participants were exposed to the fragrance within the NAR chamber.

FIG. 7(*a*) shows the diary cards, which indicate the mean change from baseline of the TNSS of the participants occurring over the fragrance challenge period of 30 minutes. The graph depicts a significant increase in the mean change from baseline of the Nasal Symptom responders 70 that is more significant than that experienced by other participants.

FIG. 7(*b*) shows the nasal patency of the Nasal Symptom responders and AcR responders of FIG. 7(*a*). The nasal patency was determined by measuring the minimal cross-sectional area at the end of the 30 minute fragrance challenge period. There was no decrease in nasal patency of the Nasal Symptom responders, while there was approximately $-19.38\pm2.75\%$ decrease in AcR responders 72, at $p<0.0001$.

Figure 8A:
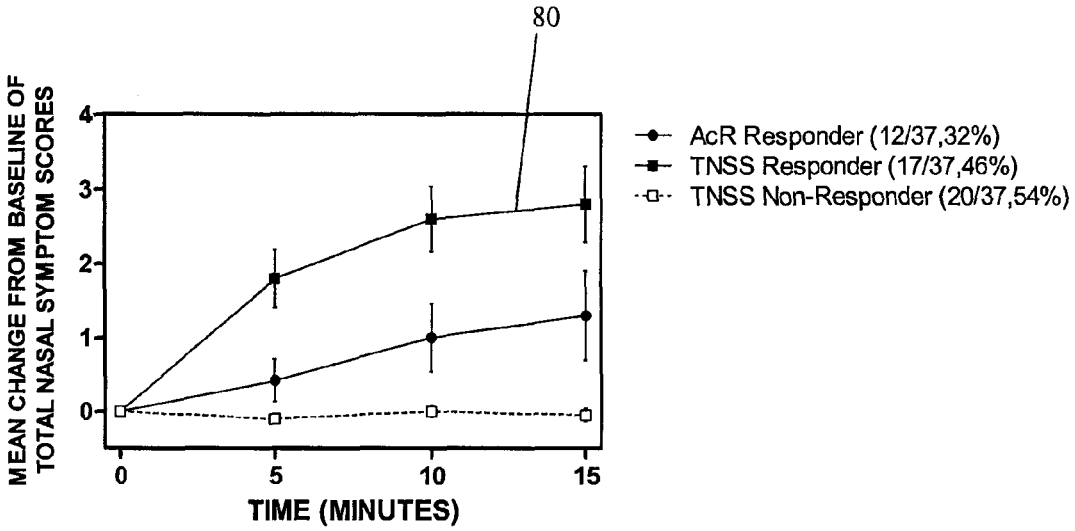
FIG. 8(*a*) is a graphical representation of the results of an irritant challenge period of 15 minutes in accordance with Study 1 showing the increase in mean change from baseline of the total nasal symptoms score of participants.
Figure 8B:
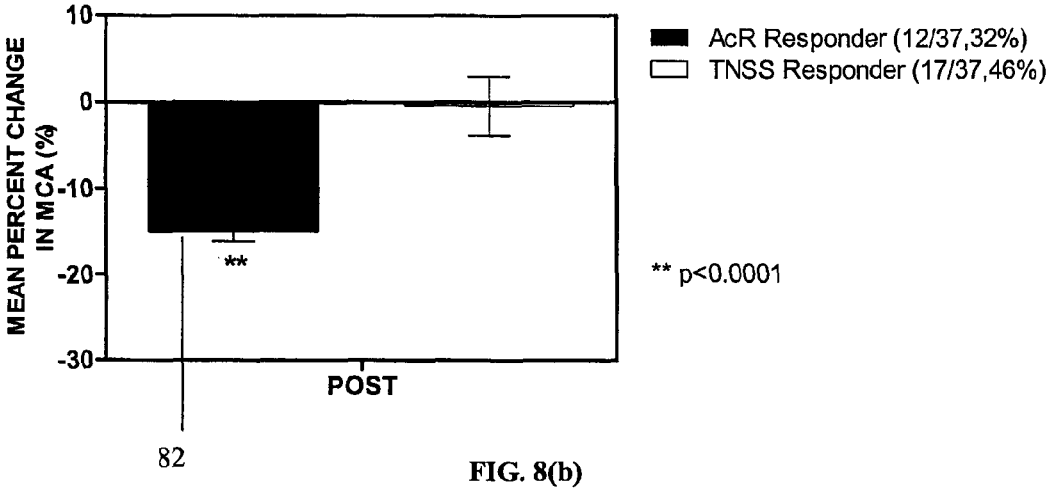

FIGS. 8(*a*)-(*b*) depict the results of response to the irritant challenge by the participants. In this challenge an irritant having a significant odour circulated in the NAR chamber for a 15 minute challenge period. The participants were exposed to the irritant within the NAR chamber.

FIG. 8(*a*) shows the diary cards, which indicate the mean change from baseline of the TNSS of the participants occurring over the irritant challenge period of 15 minutes. The graph depicts an increase in the mean change from baseline of the Nasal Symptom responders 80 that is more significant than that experienced by other participants.

FIG. 8(*b*) shows the nasal patency of the Nasal Symptom responders and AcR responders of FIG. 8(*a*). The nasal patency was determined by measuring the minimal cross-sectional area at the end of the 15 minute irritant challenge period. The change in nasal patency in the Nasal Symptom responders and AcR responders was minimal. However, if only the AcR responders 82 were considered, there was a statistically significant decrease in the minimal cross-sectional area, at $p<0.0001$.

Figure 9A:
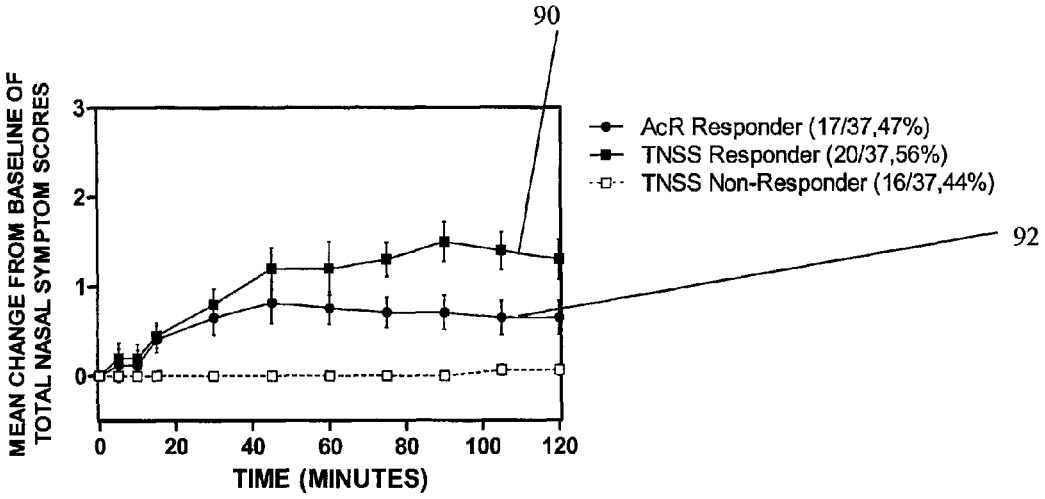
FIG. 9(*a*) is a graphical representation of the results of an ozone challenge period of 120 minutes in accordance with Study 1 showing the increase in mean change from baseline of the total nasal symptoms score of participants.
Figure 9B:
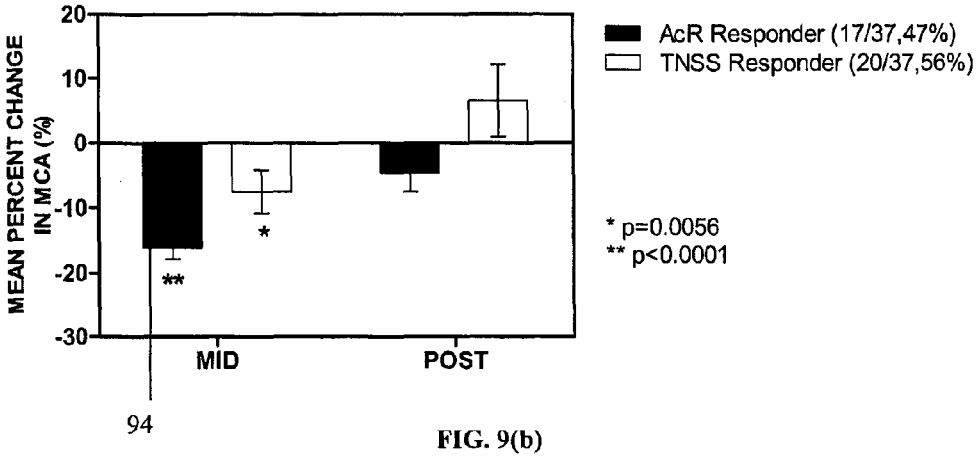

FIGS. 9(*a*)-(*b*) depict the results of response to the ozone challenge by the participants. In this challenge ozone circulated in the NAR chamber for a 120 minute challenge period. The participants were exposed to the ozone within the NAR chamber.

FIG. 9(*a*) shows the diary cards, which indicate the mean change from baseline of the TNSS of the participants occurring over the ozone challenge period of 120 minutes. Both Nasal Symptom responders 90 and AcR responders 92 showed great increases in the mean change from baseline of TNSS of the midpoint of this challenge. The mean change from baseline of the TNSS leveled off in the latter half of the challenge.

FIG. 9(*b*) shows the nasal patency of the Nasal Symptom responders and AcR responders of FIG. 8(*a*). The nasal patency was determined by measuring the minimal cross-sectional area at the mid-point of the challenge period (60 minutes) and at the end of the challenge period (120 minutes). The most significant change in nasal patency was observed for AcR responders 94 at the mid-point of the challenge, at $p<0.0001$. There was minimal change in nasal patency at the end of the challenge period.

Figure 10:
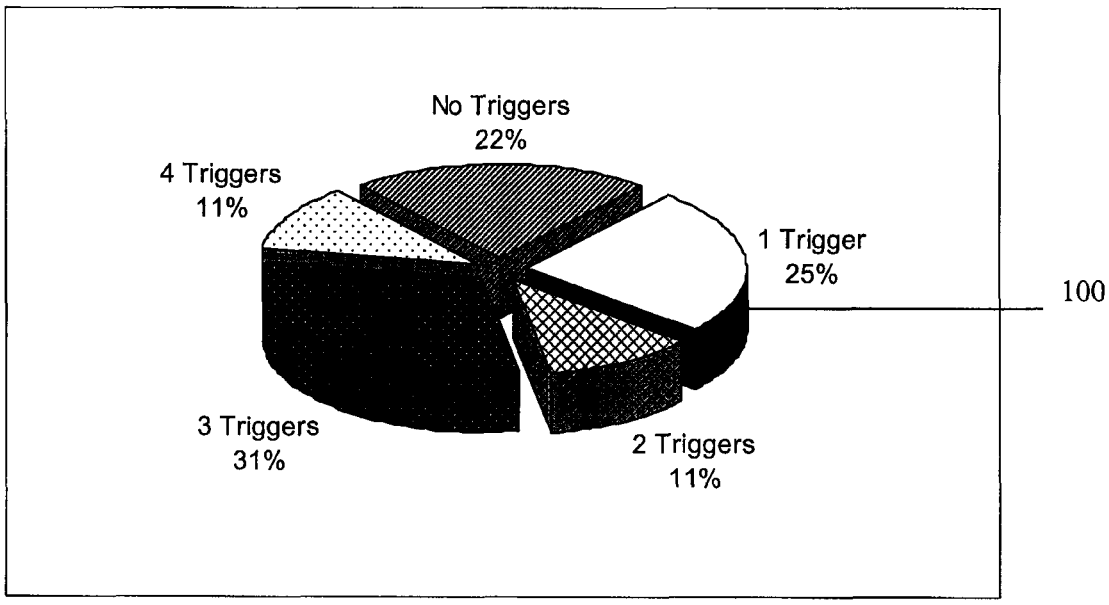
FIG. 10 is a graphical representation of the distribution of responders with mono or pluri-responses to five NAR triggers of the NAR challenges in accordance with Study 1.

FIG. 10 depicts the NAR chamber model phenotypes of participants for Study 1 generally. In particular it shows the distribution of responders with mono-responses 100 or pluri-responses to the NAR triggers. As shown in FIG. 10, 22% of NAR participants did not respond to any NAR triggers tested, 25% responded to only one trigger, 11% responded to 2 triggers, 31% responded to 3 triggers, and 11% responded to 4 triggers. No patients responded to all triggers. The most common trigger in all of the responders was temperature related challenges. Generally FIG. 10 indicates the specificity of the NAR trigger challenges for subsets of NAR patients and indicates that this model can be used to phenotype patients.

Study 2

Another study, Study 2, was conducted utilizing the NAR chamber and involving a variety of NAR challenges, including a cold dry air challenge and an ozone challenge. Study 2 was performed from December 2009 to January 2010. The participants included 52 individuals identified as affected with Non-Allergic Rhinitis and 10 healthy normal volunteers. NAR participants were screened to include those who: had a negative skin prick test to a panel of allergens; reported 1 or more NAR triggers; and had no history of seasonal allergies.

Twenty six (26) participants were included in the analysis for the cold dry air challenge. These participants were selected because they were considered responders for the cold dry air challenge based on their TNSS. The TNSS evaluated nasal congestion, rhinorhea, and post nasal drip. Each of these symptoms were evaluated on a scale of 0-4 for a maximum score of 12. The mean change from baseline of the TNSS was <4 out of 12.

The total ocular symptom score (TOSS) included itchy, watery/tearing, and red eyes. Each of these symptoms was rated on a 4 point scale (to a maximum of 12 points).

Twenty six (26) participants were included in the analyses for the ozone challenge. These participants were selected because they were considered responders for ozone based on their TNSS. Similarly, as described above, participants rated both nasal and ocular symptoms.

The participants were assessed during and after the challenges. In particular, their TNSS and their TOSS were assessed. Some of the results of Study 2 are described below and in FIGS. 11(*a*)-14(*b*). Generally, Study 2 shows that healthy normal volunteers do not respond to the NAR triggers of the NAR challenges conducted in the NAR chamber. This evidences the specificity of the model and its utility as an allergic assessment means. It further shows the results obtained from participants who are more symptomatic than those involved in Study 1 and indicates that NAR patients could be screened in this way.

Figure 11A:
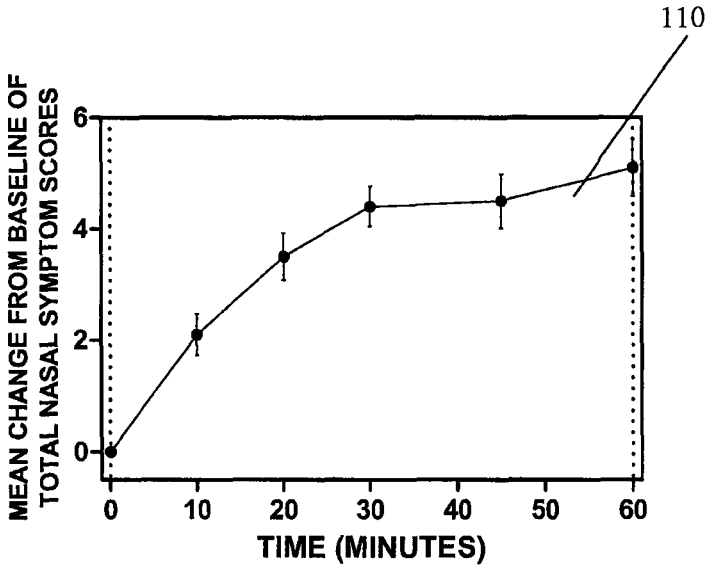
FIG. 11(*a*) is a graphical representation of the increase in mean change from baseline of the total nasal symptom score over a cold dry air challenge period of 60 minutes showing total nasal symptom responders in accordance with Study 2.
Figure 11B:
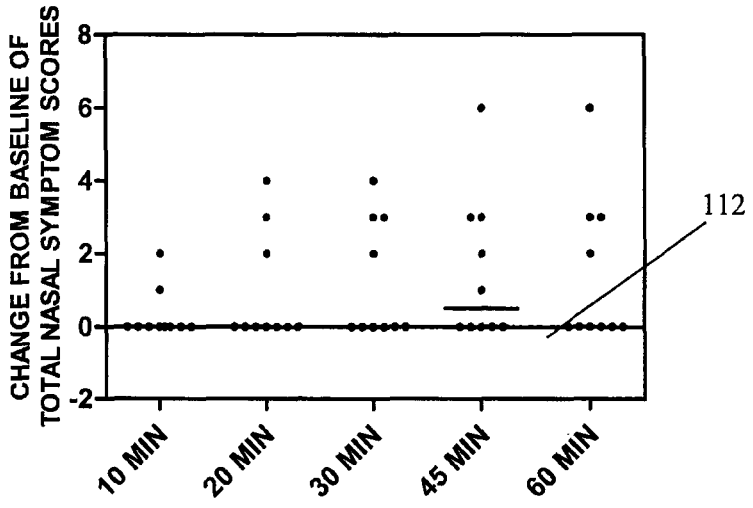

FIGS. 11(*a*)-(*b*) depict the results of participant specificity for TNSS with the cold dry air challenge. In this challenge cold dry air circulated in the NAR chamber for a 60 minute challenge period. The participants were exposed to the cold dry air within the NAR chamber. In particular, FIGS. 11(*a*)-(*b*) depict the diary cards, which indicate the mean change from baseline of the TNSS of the participants occurring over the cold dry air challenge period of 60 minutes.

FIG. 11(*a*) shows a significant increase in the mean change from baseline of the total nasal symptoms score in Nasal Symptom responders 110 over the cold dry air challenge period.

FIG. 11(*b*) shows data from healthy normal volunteers as presented in a scatter plot with a line 112 at the median.

Figure 12A:
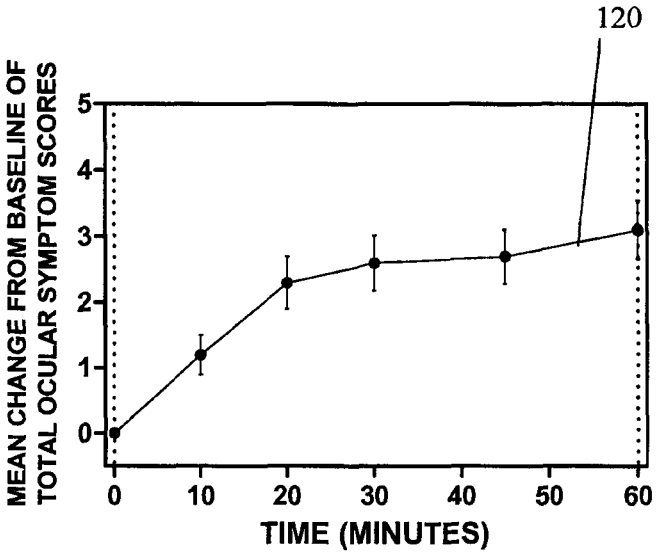
FIG. 12(*a*) is a graphical representation of the mean change from baseline of the total ocular symptom score over a cold dry air challenge period of 60 minutes showing total nasal symptom responders in accordance with Study 2.
Figure 12B:
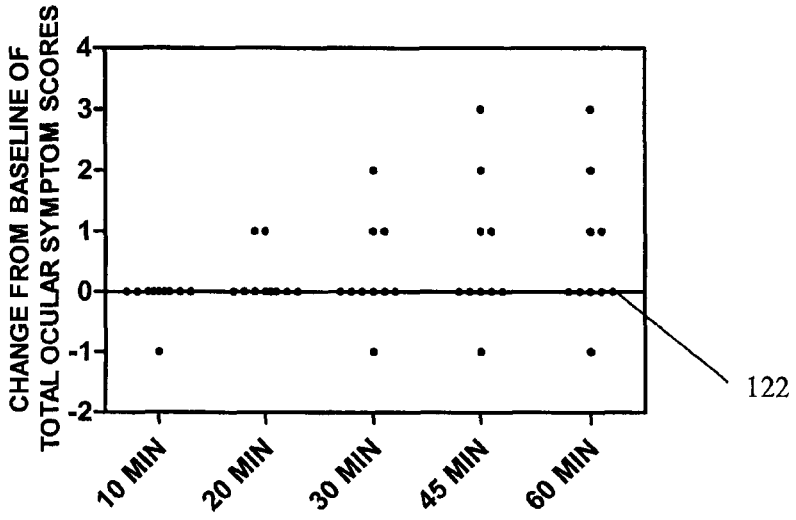

FIGS. 12(*a*)-(*b*) depict the results of participant specificity for total ocular symptom scores with the cold dry air challenge. In this challenge cold dry air circulated in the NAR chamber for a 60 minute challenge period. The participants were exposed to the cold dry air within the NAR chamber. In particular, FIGS. 11(*a*)-(*b*) depict the diary cards, which indicate the mean change from baseline of the total ocular symptom score of the participants occurring over the cold dry air challenge period of 60 minutes.

FIG. 12(*a*) shows a significant increase in the mean change from baseline of the total ocular symptoms score in Nasal Symptom responders 120 over the cold dry air challenge period.

FIG. 12(*b*) shows data from healthy normal volunteers as presented in a scatter plot with a line 122 at the median.

Figure 13A:
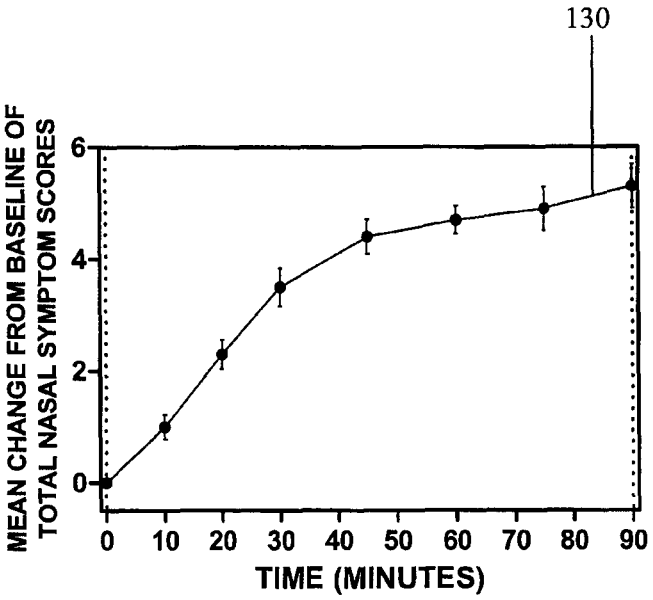
FIG. 13(*a*) is a graphical representation of the increase in mean change from baseline of the total nasal symptom score over an ozone challenge period of 90 minutes showing total nasal symptom responders in accordance with Study 2.
Figure 13B:
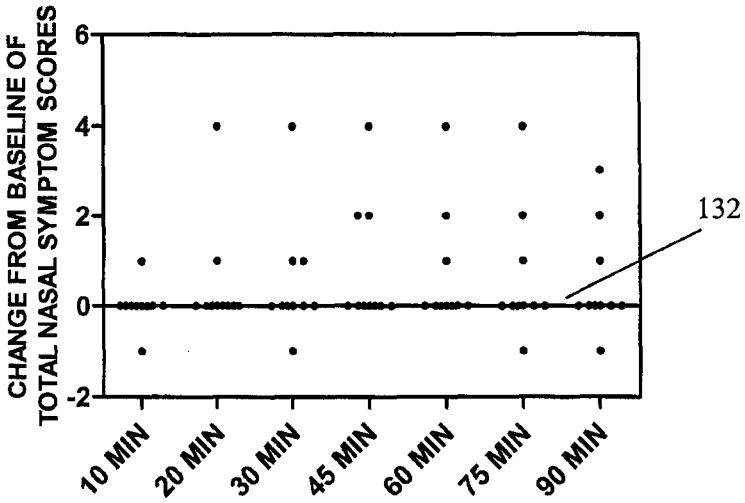

FIGS. 13(*a*)-(*b*) depict the results of participant specificity for TNSS with the ozone challenge. In this challenge ozone circulated in the NAR chamber for a 90 minute challenge period. The participants were exposed to the ozone within the NAR chamber. In particular, FIGS. 11(*a*)-(*b*) depict the diary cards, which indicate the mean change from baseline of the TNSS of the participants occurring over the ozone challenge period of 90 minutes.

FIG. 13(*a*) shows a significant increase in the mean change from baseline of the TNSS in Nasal Symptom responders 130 over the cold dry air challenge period.

FIG. 13(*b*) shows data from healthy normal volunteers as presented in a scatter plot with a line 132 at the median.

Figure 14A:
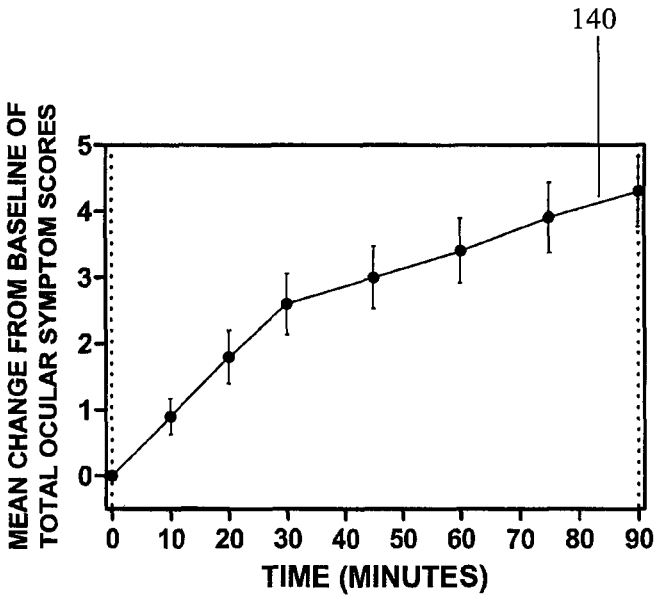
FIG. 14(*a*) is a graphical representation of the increase in the mean change from baseline of the total ocular symptom score over an ozone challenge period of 90 minutes showing total nasal symptom responders in accordance with Study 2.
Figure 14B:
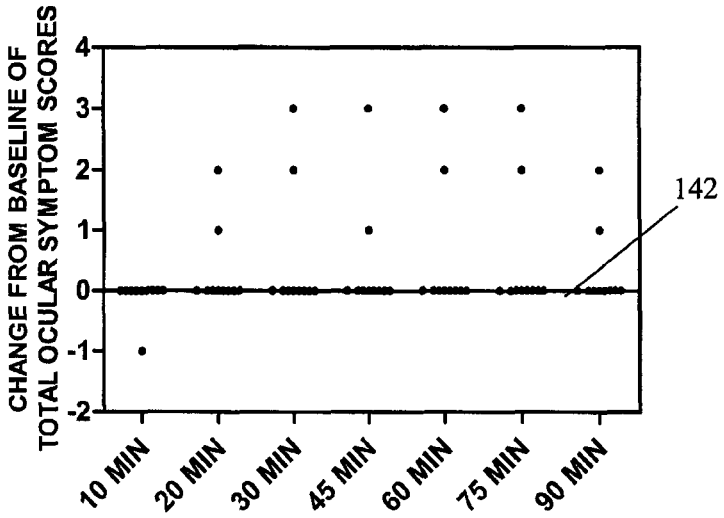

FIGS. 14(*a*)-(*b*) depict the results of participant specificity for total ocular symptom scores with the ozone challenge. In this challenge ozone circulated in the NAR chamber for a 90 minute challenge period. The participants were exposed to the ozone within the NAR chamber. In particular, FIGS. 11(*a*)-(*b*) depict the diary cards, which indicate the mean change from baseline of the total ocular symptom score of the participants occurring over the ozone challenge period of 90 minutes.

FIG. 13(*a*) shows a significant increase in the mean change from baseline of the total ocular symptoms score in Nasal Symptom responders 140 over the cold dry air challenge period.

FIG. 13(*b*) shows data from healthy normal volunteers as presented in a scatter plot with a line 142 at the median.

It will be appreciated by those skilled in the art that other variations of the embodiments described herein may also be practiced without departing from the scope of the invention. Other modifications are therefore possible. For example, other challenges may be incorporated into the method of the present invention. Such challenges may require varying methods and chamber configurations. Such challenges may include for example a capsaicin challenge. The method of the present invention may additionally incorporate further measurements. Such measurements may include measurements relating to the sensitivity levels of one or more subjects, for example such as heat-rate, sweat response or other relevant measurements. A variety of sensing means may be applied to capture such measurements, and such measurements may be incorporated into reporting and results of the present invention.

We claim:

1. A method of exposing human subjects to one or more non-allergic rhinitis trigger environments, the method comprising:

(a) selecting one or more non-allergic rhinitis challenges from the group consisting of cold dry air and temperature change;

(b) undertaking for each of the one or more non-allergic rhinitis challenges the following:

(i) installing an air handling system and a chamber, the chamber comprising a subject seating area;

(ii) creating a trigger environment corresponding to the non-allergic rhinitis challenge within the chamber by discharging air from the air handling system towards the subject seating area within the chamber;

(iii) exposing one or more human subjects to the trigger environment by positioning the one or more human subjects within the subject seating area within the chamber, and directing the air from the air handling system to the human subjects for a period of time; and (iv) assessing the exposure of the one or more human subjects to the trigger environment to produce challenge data; and (c) evaluating the challenge data of the one or more non-allergic rhinitis challenges.

2. The method of claim 1, further comprising:

assessing the exposure of the one or more subjects to the trigger environment by one or more investigators visually observing the subjects within the chamber.

3. The method of claim 1, further comprising:

one or more investigators communicating with the one or more human subjects during the one or more non-allergic rhinitis challenges.

4. The method of claim 1, further comprising:

producing the challenge data in a digital format; and transferring the challenge data; and electronically storing the challenge data.

5. The method of claim 4, further comprising:

generating reports by accessing and utilizing the challenge data.

6. The method of claim 1, wherein the one or more non-allergic rhinitis challenges comprises cold dry air, and the method comprises discharging conditioned air at a temperature of 14 ±5° C. and a relative humidity of <15%, and directing the conditioned air towards the one or more human subjects at the subject seating area at an air velocity of 5 ±3 feet/second.

7. The method of claim 1, wherein the one or more non-allergic rhinitis challenges comprises temperature change, and the method comprises:

discharging first conditioned air at a temperature of 35 ±5° C. and a relative humidity of 10-40%, and directing the first conditioned air towards the one or more human subjects at the subject seating area at an air velocity of 5 ±3 feet/second for approximately 1 hour; and switching to discharging second conditioned air at a temperature of 14 ±5° C. and a relative humidity of 10-40%, and directing the second conditioned air towards the one or more human subjects at the subject seating area at an air velocity of 5 ±3 feet/second for approximately 1 hour.

8. The method of claim 1, further comprising at least one of:

performing acoustic rhinometry on the one or more human subjects at least before and after exposing the one or more human subjects to the trigger environment;

performing nasal biomarker collection on the one or more human subjects at least before and after exposing the one or more human subjects to the trigger environment;

obtaining a total nasal symptom score (TNSS) for the one or more human subjects at least before and after exposing the one or more human subjects to the trigger environment; and collecting visual analog scale (VAS) measures from the one or more human subjects at least before and after exposing the one or more human subjects to the trigger environment.

9. The method of claim 1, wherein the air handling system comprises a velocity tube system, and the method comprises discharging conditioned air at a temperature of 14 ±5° C., and directing the conditioned air with the velocity tube system towards the one or more human subjects at the subject seating area.

10. The method of claim 1, wherein the air handling system comprises a velocity tube system, and the method comprises discharging conditioned air at a relative humidity of <15%, and directing the conditioned air with the velocity tube system towards the one or more human subjects at the subject seating area.

11. The method of claim 1, wherein the air handling system comprises a velocity tube system, and the method comprises directing the conditioned air with the velocity tube system towards the one or more human subjects at the subject seating area at an air velocity of 5 ±3 feet/second.

12. The method of claim 1, wherein the air handling system comprises a velocity tube system, and the method comprises:

discharging first conditioned air at a first temperature, and directing the first conditioned air with the velocity tube system towards the one or more human subjects at the subject seating area for a first period of time; and switching to discharging second conditioned air at a second temperature, and directing the second conditioned air with the velocity tube system towards the one or more human subjects at the subject seating area for a second period of time.

13. The method of claim 12, wherein the first temperature is 35 ±5° C.

14. The method of claim 13, wherein the second temperature is 14 ±5° C.

15. The method of claim 12, comprising discharging each of the first and second conditioned air at a relative humidity of 10-40%.

16. The method of claim 12, comprising discharging each of the first and second conditioned air at an air velocity of 5 ±3 feet/second.

17. The method of claim 12, wherein each of the first and second periods of time is approximately one hour.

18. The method of claim 1, comprising setting a target temperature, a target relative humidity and a target air velocity for the air from the air handling system being discharged towards the subject seating area within the chamber to create the trigger environment.

19. The method of claim 18, wherein the air handling system comprises a base system and a velocity tube system, and the method comprises:

with the base system, controlling the temperature, humidity and volume of air entering the chamber via one or more supply vents; and with the velocity tube system, controlling temperature and direction of air flow discharged towards the one or more human subjects' faces.

20. The method of claim 19, wherein the one or more non-allergic rhinitis challenges comprises cold dry air, and the method comprises discharging conditioned air at a temperature of 14 ±5° C. and a relative humidity of <15%, and directing the conditioned air with the velocity tube system towards the one or more human subjects at the subject seating area at an air velocity of 5 ±3 feet/second.

21. The method of claim 19, wherein the one or more non-allergic rhinitis challenges comprises temperature change, and the method comprises:

discharging first conditioned air at a temperature of 35 ±5° C. and a relative humidity of 10-40%, and directing the first conditioned air with the velocity tube system towards the one or more human subjects at the subject seating area at an air velocity of 5 ±3 feet/second for approximately 1 hour; and switching to discharging second conditioned air at a temperature of 14 ±5° C. and a relative humidity of 10-40%, and directing the second conditioned air with the velocity tube system towards the one or more human subjects at the subject seating area at an air velocity of 5 ±3 feet/second for approximately 1 hour.

* * * * *